US007533972B2

(12) United States Patent
Mita

(10) Patent No.: US 7,533,972 B2
(45) Date of Patent: May 19, 2009

(54) INKJET HEAD AND MANUFACTURING METHOD THEREOF

(75) Inventor: Tsuyoshi Mita, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 375 days.

(21) Appl. No.: 11/048,887

(22) Filed: Feb. 3, 2005

(65) Prior Publication Data

US 2005/0174393 A1 Aug. 11, 2005

(30) Foreign Application Priority Data

Feb. 6, 2004 (JP) ..... 2004-030525

(51) Int. Cl.
*B41J 2/05* (2006.01)
*B41J 2/14* (2006.01)

(52) U.S. Cl. ..... 347/68; 347/50

(58) Field of Classification Search ..... 347/50, 347/68–72

See application file for complete search history.

(56) References Cited

U.S. PATENT DOCUMENTS

| | | | | |
|---|---|---|---|---|
| 6,502,928 | B1 * | 1/2003 | Shimada et al. | 347/68 |
| 6,787,811 | B2 | 9/2004 | Saito et al. | |
| 2003/0112298 | A1 | 6/2003 | Sato et al. | |
| 2004/0001120 | A1 * | 1/2004 | Murai | 347/68 |

FOREIGN PATENT DOCUMENTS

| | | | |
|---|---|---|---|
| EP | 0 0976 560 | A2 | 2/2000 |
| JP | 62-78444 | U | 5/1987 |
| JP | 04-243102 | A | 8/1992 |
| JP | 5-48235 | A | 2/1993 |
| JP | 5-261921 | A | 10/1993 |
| JP | 6-93418 | A | 4/1994 |
| JP | 08-1977 | A | 1/1996 |
| JP | 8-267763 | A | 10/1996 |
| JP | 11-348297 | A | 12/1999 |
| JP | 2000-198197 | A | 7/2000 |
| JP | 2000-329073 | A | 11/2000 |
| JP | 2001-47623 | A | 2/2001 |

(Continued)

*Primary Examiner*—Stephen D Meier
*Assistant Examiner*—Geoffrey Mruk
(74) *Attorney, Agent, or Firm*—Birch, Stewart, Kolasch & Birch LLP

(57) ABSTRACT

The inkjet head includes: a plurality of ink discharge nozzles which are arranged two-dimensionally; a plurality of pressure chambers which are in communication with the ink discharge nozzles so as to store ink, the pressure chambers being two-dimensionally arranged in correspondence with the ink discharge nozzles; a plurality of piezoelectric elements; a common electrode which is disposed on pressure chamber sides of the piezoelectric elements; a plurality of discrete electrodes which are disposed on sides of the piezoelectric elements opposite to the common electrode; and a plurality of discrete lead electrodes which feed electricity to the discrete electrodes, wherein: each of the piezoelectric elements is deformed by applying voltage to the common electrode and the discrete electrode so that a volume of the pressure chamber is varied to discharge a droplet of the ink from the ink discharge nozzle; and with respect to each pair of the discrete electrode and discrete lead electrode corresponding to each of the pressure chambers, when T1 is a thickness of the discrete electrode and T2 is a thickness of the discrete lead electrode which feed electricity to the discrete electrode, the discrete electrode and the discrete lead electrode are configured so that T1 and T2 satisfy the following formula: T1<T2.

9 Claims, 20 Drawing Sheets

FOREIGN PATENT DOCUMENTS

| | | | |
|---|---|---|---|
| JP | 2001-80068 | A | 3/2001 |
| JP | 2002-46269 | A | 2/2002 |
| JP | 2003-69103 | A | 3/2003 |
| JP | 2003-152299 | A | 5/2003 |
| JP | 2003-154646 | A | 5/2003 |

* cited by examiner

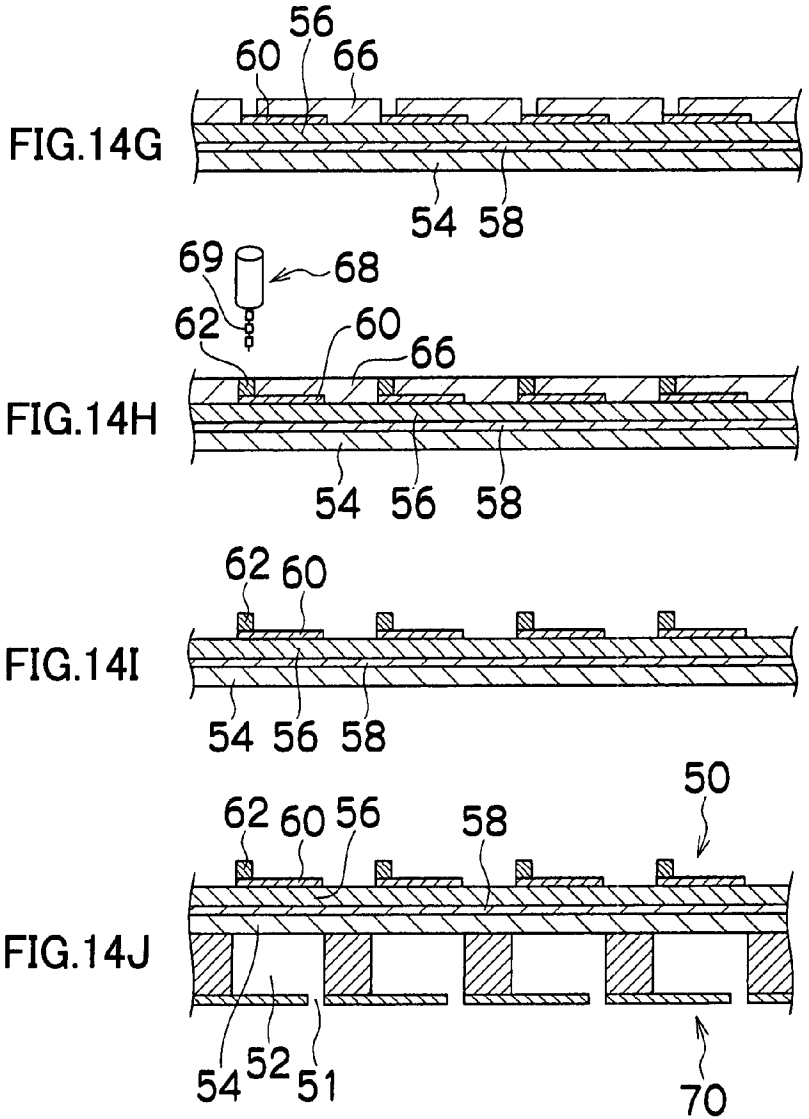
FIG.14G
FIG.14H
FIG.14I
FIG.14J
50
70
58
54
56
66
60
68
69
62
51
52
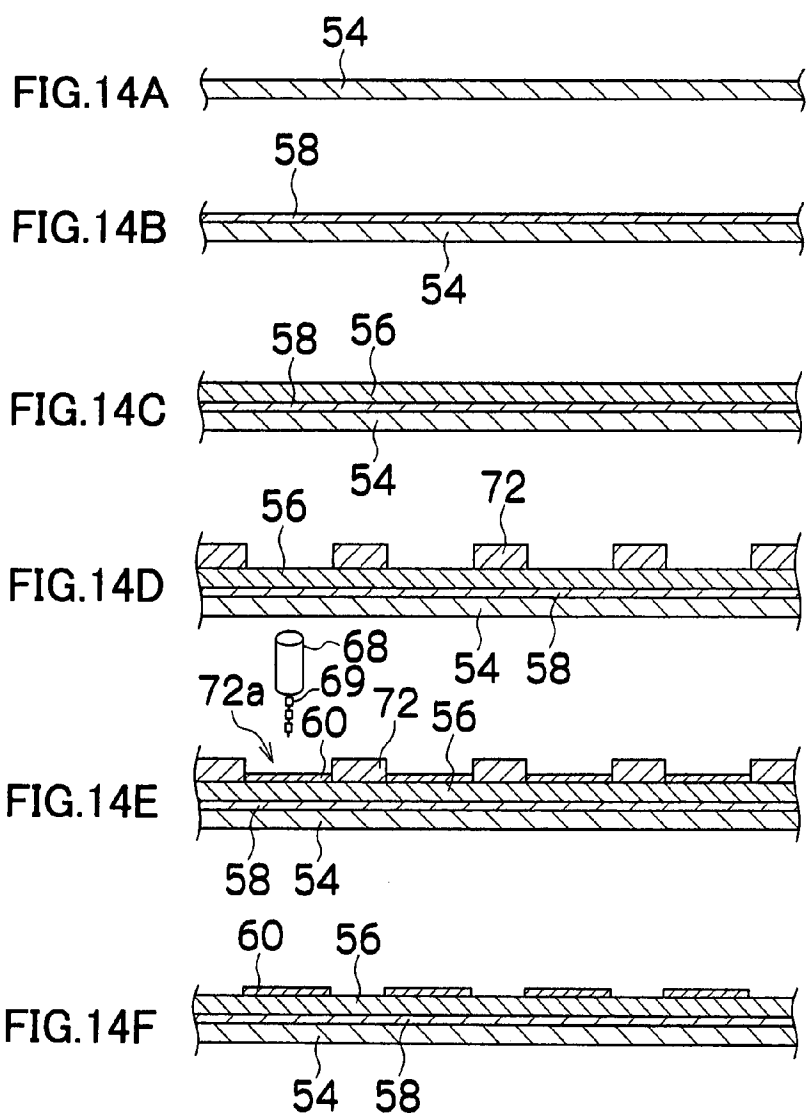
FIG.14A
FIG.14B
FIG.14C
FIG.14D
FIG.14E
FIG.14F
54
58
56
72
72a
68
69
60

INKJET HEAD AND MANUFACTURING METHOD THEREOF

BACKGROUND OF THE INVENTION

1. Field of the Invention

The present invention relates to an inkjet head and a manufacturing method thereof, and more specifically to an inkjet head for discharging ink by using a piezoelectric element, and a manufacturing method of the inkjet head wherein wiring for discrete electrodes is formed by the aerosol method.

2. Description of the Related Art

Conventionally, an inkjet recording apparatus (an inkjet printer) that has an inkjet head (ink discharge head) with a plurality of arranged nozzles (ink discharge ports) and form images on a recording medium by discharging ink (ink droplets) from nozzles toward the recording medium as the inkjet head moves relative to the recording medium, are known as an image forming apparatus.

For example, a known ink discharging method in such an inkjet recording apparatus is a piezoelectric method in which a diaphragm constituting a portion of a pressure chamber (ink chamber) is deformed by the deformation of a piezoelectric element (piezo element) so as to change the volume of the pressure chamber. Therefore, ink is introduced from an ink supply channel to the pressure chamber when the volume of the pressure chamber increases, and the ink in the pressure chamber is discharged as droplets from the nozzle when the volume of the pressure chamber decreases.

In inkjet recording apparatuses as well, it is desirable to record images that have the same high quality as transfer prints, and to achieve this end, the size of the nozzle must be made smaller to reduce the size of the ink droplet discharged from the nozzle, and the nozzles must be more densely arranged.

Thus, in order to increase the density of the nozzles (recording dots), one known example is to reduce breakages in the electrode wiring portion by setting the width of the wiring portion in at least one of the electrodes which are disposed on both the pressure chamber side of the piezoelectric element and on the side opposite to the pressure chamber, so as to be smaller than half the maximum width of the aperture of the hollow portion of the pressure chamber (referred to Japanese Patent Application Publication No. 2001-80068). Therefore, it is possible to reduce the size of the inkjet head, and to increase the density of the dots by manipulating the wiring portion of the electrodes.

Similarly, another known example is to set the width of the wiring portion so as to be less than ⅓ the maximum width of the aperture of the hollow portion of the pressure chamber (referred to Japanese Patent Application Publication No. 2003-154646, for example).

In those above examples of prior art, an insulating layer is interposed on the common electrode side to inactivate the bottom portion of the wiring.

Also, for example, an aspect is known as each piezoelectric actuators in which surface side electrodes and the signal line or conductive layer corresponding to the flexible wiring substrate are electrically connected via a single solder bump so as to have that has the desired gap (referred to Japanese Patent Application Publication No. 2003-69103). Therefore, it is enable to be high-density electrical joining between the wiring substrate and the flat piezoelectric actuator elements disposed in a high-density array (i.e., a matrix array).

Conventionally, in order to achieve a higher nozzle density in the inkjet heads in this manner, a method for keeping the wiring to ½ (or ⅓) or less the width of the pressure chamber aperture, or provide a flexible connection using a solder bump correlated with the matrix array is known as one of the methods for providing wiring from the piezoelectric element to the flexible printed circuit board (FPC) or another external electrode lead portion. Also, for except the field of inkjet head, the aerosol method as described below is known as the method to form the circuit substrate, the wiring of the capacitors or display, and the like.

As used herein, the term "aerosol method" refers to aerosol gas deposition or simply gas deposition, the powder method, or the like. These methods are to blow argon or another carrier gas onto ultrafine PZT particles (lead zirconate titanate $Pb(Zr, Ti)O_3$), the fine PZT particles taken up by the gas are discharged together with the gas through a spray nozzle at high speed to the substrate to deposit the particles, and the substrate is heated to form a film. Therefore, since the above described aerosol methods directly deposit particles to form a film, it is possible to obtain a wide range of film thicknesses.

For example, a known method which forms a very small, ultrafine particle film with good accuracy to the desired area alone entails covering the substrate with a mask and blowing ultrafine particles onto the circuit substrate by way of an aperture to form an ultrafine particle film (referred to Japanese Patent Application Publication No. 06-093418). Therefore, it is possible to form a very fine pattern with a high aspect ratio without bleeding.

Also, according to a circuit substrate which is integrally formed resistors, capacitors, and other passive elements, processes are known in which at least a portion of the resistors, capacitors, and other passive elements are formed by an ultrafine particles film that is formed with the gas deposition method. In particular, while the deposit position of the ultrafine particles is determined by the nozzle position, dielectric components and electrodes are formed by gas deposition (referred to Japanese Patent Application Publication No. 05-048235). Therefore, since the product is devoid of thermal degradation, it is possible to expand the degree of freedom for substrate materials and formation materials.

Furthermore, there are known methods for fabricating conductive members in which, for example, wiring on a substrate and wiring for simple matrix organic EL display apparatuses are connected by using the inkjet method or the gas deposition method (refer to Japanese Patent Application Publication No. 2003-152299, for example). Therefore, it is possible to connect conductive members without an insulating layer.

However, according to configurations with high-density wiring from the piezoelectric elements to the flexible printed wiring board and the circuit board as cited in Japanese Patent Application Publication Nos. 2001-80068 and 2003-154646, it is possible to configure with up to four rows by arranging two rows in a configuration as shown in FIG. 6 of Japanese Patent Application Publication No. 2001-80068, for example. But, when the matrix array has six or eight rows, there is drawback in which the width of the wiring must be made as narrow as possible due to the nozzle pitch so that the wiring resistance increases.

Also, in conventional methods such as sputtering and vapor deposition, since a thickness of several μm or more is difficult from the aspect of the film formation rate, the width of the wiring cannot be significantly reduced. In those conventional methods, it is also necessary to use a mask in locations in which film is not desired because the film is applied to the entire surface. Therefore, there are drawbacks in which removal and surface polishing must be carried out in later steps in order to make the electrodes independent.

It is possible to form electrodes with a high aspect ratio where plating is concerned. However, while masking is required, the current density and the hardness of plating film vary depending on the shape of the wiring pattern. Therefore, there is a drawback in which it is difficult to form a wiring pattern with a constant hardness.

In view of the above, it is possible to consider a method in which a solder bump is used as described in Japanese Patent Application Publication No. 2003-69103. However, soldering in a two-dimensional array is also technically difficult from aspects of surface accuracy, warping, or pressure conditions. In addition, there are also drawbacks such as degradation of element characteristics and the flow of solder into active areas due to soldering in the vicinity of active areas.

Furthermore, the methods as described in Japanese Patent Application Publication Nos. 6-93418, 5-48235, and 2003-152299, are not related to above described inkjet recording apparatuses. Therefore, those cannot directly be used for forming wiring in inkjet heads.

SUMMARY OF THE INVENTION

The present invention has been contrived in view of such circumstances, and an object thereof is to provide an inkjet head and a manufacturing method thereof in which the discrete lead electrodes can be made thick, the width of the wiring portion can be reduced, and higher density can be achieved.

In order to attain the aforementioned object, the present invention is directed to an inkjet head, comprising: a plurality of ink discharge nozzles which are arranged two-dimensionally; a plurality of pressure chambers which are in communication with the ink discharge nozzles so as to store ink, the pressure chambers being two-dimensionally arranged in correspondence with the ink discharge nozzles; a plurality of piezoelectric elements; a common electrode which is disposed on pressure chamber sides of the piezoelectric elements; a plurality of discrete electrodes which are disposed on sides of the piezoelectric elements opposite to the common electrode; and a plurality of discrete lead electrodes which feed electricity to the discrete electrodes, wherein: each of the piezoelectric elements is deformed by applying voltage to the common electrode and the discrete electrode so that a volume of the pressure chamber is varied to discharge a droplet of the ink from the ink discharge nozzle; and with respect to each pair of the discrete electrode and discrete lead electrode corresponding to each of the pressure chambers, when T1 is a thickness of the discrete electrode and T2 is a thickness of the discrete lead electrode which feed electricity to the discrete electrode, the discrete electrode and discrete lead electrode are configured so that T1 and T2 satisfy the following formula: T1<T2.

According to the present invention, it is possible to dispose a two-dimensional high-density array in an inkjet head having nozzles by forming discrete lead electrodes. In particular, it is possible to reduce the resistance of the electrodes because the connective cross-sectional area is increased by increasing the thickness of the discrete lead electrodes.

Preferably, each of the discrete lead electrodes is formed so as not to be overlaid in an aperture position of the pressure chamber. Therefore, it is possible to allowing the displacement of the piezoelectric elements to remain unrestrained.

The present invention also provides the inkjet head, wherein: when D is a width of the discrete electrode in the same direction as a width of the discrete lead electrode, d is the width of the discrete lead electrode, and N is a number of rows in the breadthways direction of the two-dimensionally arranged pressure chambers, the discrete electrode, the discrete lead electrode, and the pressure chambers are configured so that the D, the d, and the N satisfy the following formula:

$$\frac{D}{\left(\frac{N}{2}\right)} > d.$$

Therefore, in addition to make the discrete lead electrodes thicker, it is possible to reduce the width of the discrete lead electrodes, and to make the wiring more highly dense.

The present invention also provides the inkjet head, wherein: when T2 is a thickness of the discrete lead electrode, d is a width of the discrete lead electrode, R is a permissible resistance value of the discrete lead electrode, ρ is a specific resistance of the discrete lead electrode, and L is a length of the lead of the discrete lead electrode, the thickness T2 and the specific resistance ρ of the discrete lead electrode are configured so that the T2, the d, the R, the ρ, and the L satisfy the following formula:

$$\frac{\rho}{T2} \leq \frac{Rd}{L}.$$

Therefore, it is possible to attain the desired wiring resistance accordingly.

Also, in order to attain the aforementioned object, the present invention is directed to an inkjet head, an inkjet head, comprising: a plurality of ink discharge nozzles which are arranged two-dimensionally; a plurality of pressure chambers which are in communication with the ink discharge nozzles so as to store ink, the pressure chambers being two-dimensionally arranged in correspondence with the ink discharge nozzles; a plurality of piezoelectric elements; a common electrode which is disposed on pressure chamber sides of the piezoelectric elements; a plurality of discrete electrodes which are disposed on sides of the piezoelectric elements opposite to the common electrode; and a plurality of discrete lead electrodes which feed electricity to the discrete electrodes, wherein: each of the piezoelectric elements is deformed by applying voltage to the common electrode and the discrete electrode so that a volume of the pressure chamber is varied to discharge a droplet of the ink from the ink discharge nozzle; with respect to each pair of the discrete electrode and discrete lead electrode corresponding to each of the pressure chambers, when T1 is a thickness of the discrete electrode and T2 is a thickness of the discrete lead electrode which feed electricity to the discrete electrode, the discrete electrode and discrete lead electrode are configured so that T1 and T2 satisfy the following formula: T1<T2; and the thicknesses T2 of the discrete lead electrodes are formed so that the resistance values of the discrete lead electrodes are equal each other. Therefore, it is possible to drive all the piezoelectric elements in the same manner.

Preferably, the thickness T2 of the lead electrodes are made uniform at the resistance value that corresponds to the lead electrode of which the length of the lead of the discrete lead electrode is the longest. Therefore, the manufacture of lead electrodes is facilitated.

Also, when D is a width in a breadthways direction of the discrete electrode, T1 is the thickness of the discrete electrode, d is a width of the discrete lead electrodes, and T2 is the thickness of the discrete lead electrode the discrete electrode and the discrete lead electrode are configured so that the D, the T1, the d, and the T2 preferably satisfy the following formulas:

$$\frac{T1}{D} \geq \frac{1}{1000} \text{ and } \frac{T2}{d} \geq 2.$$

In addition, the discrete lead electrode and the discrete electrode are preferably formed so as to be connected at two surfaces thereof each other. Therefore, it is possible to reduce the connection resistance, and to improve the connection strength.

Preferably, the discrete electrodes are formed by an aerosol method. Also, the discrete lead electrodes are preferably formed by an aerosol method. Therefore, it is possible to form electrodes with a considerable thickness.

In order to attain the aforementioned object, the present invention is directed to a method for manufacturing an inkjet head comprising: a plurality of ink discharge nozzles which are arranged two-dimensionally; a plurality of pressure chambers which are in communication with the ink discharge nozzles so as to store ink, the pressure chambers being two-dimensionally arranged in correspondence with the ink discharge nozzles; a plurality of piezoelectric elements; a common electrode which is disposed on pressure chamber sides of the piezoelectric elements; a plurality of discrete electrodes which are disposed on sides of the piezoelectric elements opposite to the common electrode; and a plurality of discrete lead electrodes which feed electricity to the discrete electrodes, wherein: each of the piezoelectric elements is deformed by applying voltage to the common electrode and the discrete electrode so that a volume of the pressure chamber is varied to discharge a droplet of the ink from the ink discharge nozzle, the method, comprising the steps of: forming a resist mask on the common electrode formed on a diaphragm, and forming the piezoelectric elements and the discrete electrodes in positions corresponding to the pressure chambers, at least one of the piezoelectric elements and the discrete electrodes being formed by an aerosol method.

Also, In order to attain the aforementioned object, the present invention is directed to a method for manufacturing an inkjet head comprising: a plurality of ink discharge nozzles which are arranged two-dimensionally; a plurality of pressure chambers which are in communication with the ink discharge nozzles so as to store ink, the pressure chambers being two-dimensionally arranged in correspondence with the ink discharge nozzles; a plurality of piezoelectric elements; a common electrode which is disposed on pressure chamber sides of the piezoelectric elements; a plurality of discrete electrodes which are disposed on sides of the piezoelectric elements opposite to the common electrode; and a plurality of discrete lead electrodes which feed electricity to the discrete electrodes, wherein: each of the piezoelectric elements is deformed by applying voltage to the common electrode and the discrete electrode so that a volume of the pressure chamber is varied to discharge a droplet of the ink from the ink discharge nozzle, the method, comprising the steps of: forming a film of the common electrode and the piezoelectric elements on a diaphragm; forming a resist mask on the film of the common electrode and the piezoelectric elements; and forming the discrete electrodes by an aerosol method in positions corresponding to the pressure chambers.

Furthermore, In order to attain the aforementioned object, the present invention is directed to A method for manufacturing an inkjet head comprising: a plurality of ink discharge nozzles which are arranged two-dimensionally; a plurality of pressure chambers which are in communication with the ink discharge nozzles so as to store ink, the pressure chambers being two-dimensionally arranged in correspondence with the ink discharge nozzles; a plurality of piezoelectric elements; a common electrode which is disposed on pressure chamber sides of the piezoelectric elements; a plurality of discrete electrodes which are disposed on sides of the piezoelectric elements opposite to the common electrode; and a plurality of discrete lead electrodes which feed electricity to the discrete electrodes, wherein: each of the piezoelectric elements is deformed by applying voltage to the common electrode and the discrete electrode so that a volume of the pressure chamber is varied to discharge a droplet of the ink from the ink discharge nozzle, the method, comprising the steps of: forming the common electrode on a diaphragm; forming a film of the piezoelectric elements and the discrete electrodes, at least one of the piezoelectric elements and the discrete electrodes being formed by an aerosol method; forming a resist mask on the film of the piezoelectric elements and the discrete electrodes; forming a pattern to the discrete electrodes and piezoelectric elements; and forming the piezoelectric elements and the discrete electrodes in positions corresponding to the pressure chambers.

The present invention also provides the method for manufacturing an inkjet head, wherein only discrete lead electrode portions which apply voltage to the discrete electrodes are formed thickly by a nozzle scan according to the aerosol method. The method for manufacturing an inkjet head also has an aspect wherein only discrete lead electrode portions which apply voltage to the discrete electrodes are formed thickly by an aerosol method using the resist mask.

Thus, by forming the discrete lead electrodes as wiring components with the aerosol method, it is possible to increase the width and thickness of the wiring, and the connective cross-sectional area with the discrete electrodes, so that the resistance of the electrodes can be reduced. Furthermore, since the configuration is advantageous for wiring in a matrix, it is possible to bring out wiring from the side surface in a matrix, and to achieve higher density in the inkjet head.

Additionally, since the aerosol method can be formed films in the same chamber by forming a piezoelectric element, a discrete electrode, and a discrete lead electrode, it is possible to simplify the manufacturing step, and to reduce manufacturing costs.

As described above, according to the inkjet head and manufacturing method thereof of the present invention, it is possible to increase the thickness of the lead electrodes, to reduce the width of the lead electrodes, and to achieve a higher density in a piezoelectric inkjet head.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein:

FIG. 8A is a plan view thereof, and FIG. 8B is a side view thereof;

FIG. 9A is a plan view thereof, and FIG. 9B is a side view thereof;

FIGS. 14A to 14J are cross-sectional views showing the sequential steps according to a method of manufacturing the print head in FIG. 13.

DETAILED DESCRIPTION OF THE PREFERRED EMBODIMENTS

Figure 1:
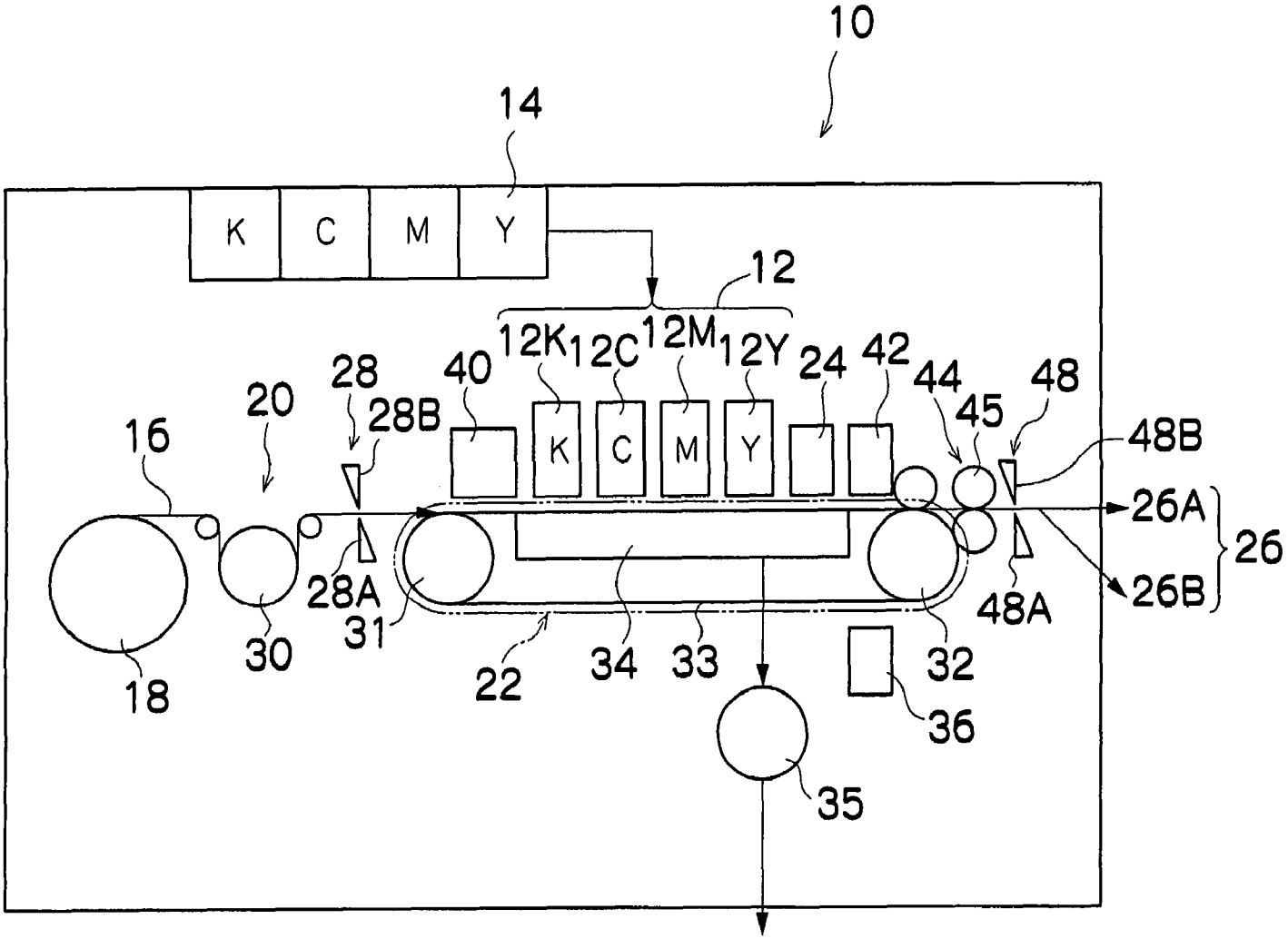
FIG. 1 is a general schematic drawing of an inkjet recording apparatus according to an embodiment of the present invention.

FIG. 1 is a general schematic drawing of an inkjet recording apparatus according to an embodiment comprising an inkjet head of the present invention.

As shown in FIG. 1, the inkjet recording apparatus 10 comprises: a printing unit 12 having a plurality of droplet discharge heads or print heads 12K, 12C, 12M, and 12Y for ink colors of black (K), cyan (C), magenta (M), and yellow (Y), respectively; an ink storing/loading unit 14 for storing inks to be supplied to the print heads 12K, 12C, 12M, and 12Y; a paper supply unit 18 for supplying recording paper 16; a decurling unit 20 for removing curl in the recording paper 16; a suction belt conveyance unit 22 disposed facing the nozzle face (ink-droplet discharge face) of the printing unit 12, for conveying the recording paper 16 while keeping the recording paper 16 flat; a print determination unit 24 for reading the printed result produced by the printing unit 12; and a paper output unit 26 for outputting image-printed recording paper (printed matter) to the exterior.

In FIG. 1, a single magazine for rolled paper (continuous paper) is shown as an example of the paper supply unit 18; however, a plurality of magazines with paper differences such as paper width and quality may be jointly provided. Moreover, paper may be supplied with a cassette that contains cut paper loaded in layers and that is used jointly or in lieu of a magazine for rolled paper.

In the case of the configuration in which roll paper is used, a cutter (first cutter) 28 is provided as shown in FIG. 1, and the continuous paper is cut into a desired size by the cutter 28. The cutter 28 has a stationary blade 28A, whose length is equal to or greater than the width of the conveyor pathway of the recording paper 16, and a round blade 28B, which moves along the stationary blade 28A. The stationary blade 28A is disposed on the reverse side of the printed surface of the recording paper 16, and the round blade 28B is disposed on the printed surface side across the conveyor pathway. When cut paper is used, the cutter 28 is not required.

In the case of a configuration in which a plurality of types of recording paper can be used, it is preferable that an information recording medium such as a bar code and a wireless tag containing information about the type of paper is attached to the magazine, and by reading the information contained in the information recording medium with a predetermined reading device, the type of paper to be used is automatically determined, and ink-droplet discharge is controlled so that the ink-droplets are discharged in an appropriate manner in accordance with the type of paper.

The recording paper 16 delivered from the paper supply unit 18 retains curl due to having been loaded in the magazine. In order to remove the curl, heat is applied to the recording paper 16 in the decurling unit 20 by a heating drum 30 in the direction opposite from the curl direction in the magazine. The heating temperature at this time is preferably controlled so that the recording paper 16 has a curl in which the surface on which the print is to be made is slightly round outward.

The decurled and cut recording paper 16 is delivered to the suction belt conveyance unit 22. The suction belt conveyance unit 22 has a configuration in which an endless belt 33 is set around rollers 31 and 32 so that the portion of the endless belt 33 facing at least the nozzle face of the printing unit 12 and the sensor face of the print determination unit 24 forms a horizontal plane (flat plane).

The belt 33 has a width that is greater than the width of the recording paper 16, and a plurality of suction apertures (not shown) are formed on the belt surface. A suction chamber 34 is disposed in a position facing the sensor surface of the print determination unit 24 and the nozzle surface of the printing unit 12 on the interior side of the belt 33, which is set around the rollers 31 and 32, as shown in FIG. 1; and the suction chamber 34 provides suction with a fan 35 to generate a negative pressure, and the recording paper 16 is held on the belt 33 by suction.

The belt 33 is driven in the clockwise direction in FIG. 1 by the motive force of a motor (not shown) being transmitted to at least one of the rollers 31 and 32, which the belt 33 is set around, and the recording paper 16 held on the belt 33 is conveyed from left to right in FIG. 1.

Since ink adheres to the belt 33 when a marginless print job or the like is performed, a belt-cleaning unit 36 is disposed in a predetermined position (a suitable position outside the printing area) on the exterior side of the belt 33. Although the details of the configuration of the belt-cleaning unit 36 are not depicted, examples thereof include a configuration in which the belt 33 is nipped with a cleaning roller such as a brush roller and a water absorbent roller, an air blow configuration in which clean air is blown onto the belt 33, or a combination of these. In the case of the configuration in which the belt 33 is nipped with the cleaning roller, it is preferable to make the line velocity of the cleaning roller different than that of the belt 33 to improve the cleaning effect.

The inkjet recording apparatus 10 can comprise a roller nip conveyance mechanism, in which the recording paper 16 is pinched and conveyed with nip rollers, instead of the suction belt conveyance unit 22. However, there is a drawback in the roller nip conveyance mechanism that the print tends to be smeared when the printing area is conveyed by the roller nip action because the nip roller makes contact with the printed surface of the paper immediately after printing. Therefore, the suction belt conveyance in which nothing comes into contact with the image surface in the printing area is preferable.

A heating fan 40 is disposed on the upstream side of the printing unit 12 in the conveyance pathway formed by the suction belt conveyance unit 22. The heating fan 40 blows heated air onto the recording paper 16 to heat the recording paper 16 immediately before printing so that the ink deposited on the recording paper 16 dries more easily.

The printing unit 12 comprises the print heads 12K, 12C, 12M, and 12Y corresponding to four ink-colors (KCMY). Each of the print heads 12K, 12C, 12M, and 12Y forms a so-called full-line head in which a line head is configured by arranging long side of a plurality of discharge heads including a plurality of discharge apertures to a length that corresponds to the maximum paper width and is disposed in perpendicular direction to the delivering direction of the recording paper 16 (hereinafter referred to as the paper conveyance direction). A specific structural example is described as following, each of the print heads 12K, 12C, 12M, and 12Y is also equipped with a device for recovering the condition of head, a device for getting rid of the head, an auxiliary head, and the like, together with the line head composed of a plurality of discharge heads.

The print heads 12K, 12C, 12M, and 12Y are arranged in this order from the upstream side (the left-hand side in FIG. 1) along the paper conveyance direction. A color print can be formed on the recording paper 16 by discharging the inks from the print heads 12K, 12C, 12M, and 12Y, respectively, onto the recording paper 16 while conveying the recording paper 16.

The printing unit 12, in which the full-line heads covering the entire width of the paper are thus provided for the respective ink colors, can record an image over the entire surface of the recording paper 16 by performing the action of moving the recording paper 16 and the printing unit 12 relatively to each other in the sub-scanning direction just once (i.e., with a single sub-scan). Higher-speed printing is thereby made possible and productivity can be improved in comparison with a shuttle type head configuration in which a print head reciprocates in the main scanning direction.

Although the configuration with the KCMY four standard colors is described in the present embodiment, combinations of the ink colors and the number of colors are not limited to those, and light and/or dark inks can be added as required. For example, a configuration is possible in which print heads for discharging light-colored inks such as light cyan and light magenta are added.

As shown in FIG. 1, the ink storing/loading unit 14 has tanks for storing the inks to be supplied to the print heads 12K, 12C, 12M, and 12Y, and the tanks are connected to the print heads 12K, 12C, 12M, and 12Y through channels (not shown), respectively. The ink storing/loading unit 14 has a warning device (e.g., a display device, an alarm sound generator, and the like) for warning when the remaining amount of any ink is low, and has a mechanism for preventing loading errors among the colors.

The print determination unit 24 has an image sensor for capturing an image of the ink-droplet deposition result of the printing unit 12, and functions as a device to check for discharge defects such as clogs of the nozzles in the printing unit 12 from the ink-droplet deposition results evaluated by the image sensor.

The print determination unit 24 of the present embodiment is configured with at least a line sensor having rows of photoelectric transducing elements with a width that is greater than the ink-droplet discharge width (image recording width) of the print heads 12K, 12C, 12M, and 12Y. This line sensor has a color separation line CCD sensor including a red (R) sensor row composed of photoelectric transducing elements (pixels) arranged in a line provided with an R filter, a green (G) sensor row with a G filter, and a blue (B) sensor row with a B filter. Instead of a line sensor, it is possible to use an area sensor composed of photoelectric transducing elements which are arranged two-dimensionally.

The print determination unit 24 reads a test pattern printed with the print heads 12K, 12C, 12M, and 12Y for the respective colors, and the discharge of each head is determined. The discharge determination includes the presence of the discharge, measurement of the dot size, and measurement of the dot deposition position.

A post-drying unit 42 is disposed following the print determination unit 24. The post-drying unit 42 is a device to dry the printed image surface, and includes a heating fan, for example. It is preferable to avoid contact with the printed surface until the printed ink dries, and a device that blows heated air onto the printed surface is preferable.

In cases in which printing is performed with dye-based ink on porous paper, blocking the pores of the paper by the application of pressure prevents the ink from coming contact with ozone and other substance that cause dye molecules to break down, and has the effect of increasing the durability of the print.

A heating/pressurizing unit 44 is disposed following the post-drying unit 42. The heating/pressurizing unit 44 is a device to control the glossiness of the image surface, and the image surface is pressed with a pressure roller 45 having a predetermined uneven surface shape while the image surface is heated, and the uneven shape is transferred to the image surface.

The printed matter generated in this manner is outputted from the paper output unit 26. The target print (i.e., the result of printing the target image) and the test print are preferably outputted separately. In the inkjet recording apparatus 10, a sorting device (not shown) is provided for switching the outputting pathway in order to sort the printed matter with the target print and the printed matter with the test print, and to send them to paper output units 26A and 26B, respectively. When the target print and the test print are simultaneously formed in parallel on the same large sheet of paper, the test print portion is cut and separated by a cutter (second cutter) 48. The cutter 48 is disposed directly in front of the paper output unit 26, and is used for cutting the test print portion from the target print portion when a test print has been performed in the blank portion of the target print. The structure of the cutter 48 is the same as the first cutter 28 described above, and has a stationary blade 48A and a round blade 48B.

Although not shown in FIG. 1, a sorter for collecting prints according to print orders is provided to the paper output unit 26A for the target prints.

Next, the structure of the droplet discharge heads or the print heads is described. The print heads 12K, 12C, 12M, and 12Y provided for the respective ink colors have the same structure, and a reference numeral 50 is hereinafter designated to any of the print heads 12K, 12C, 12M, and 12Y.

Figure 2A:
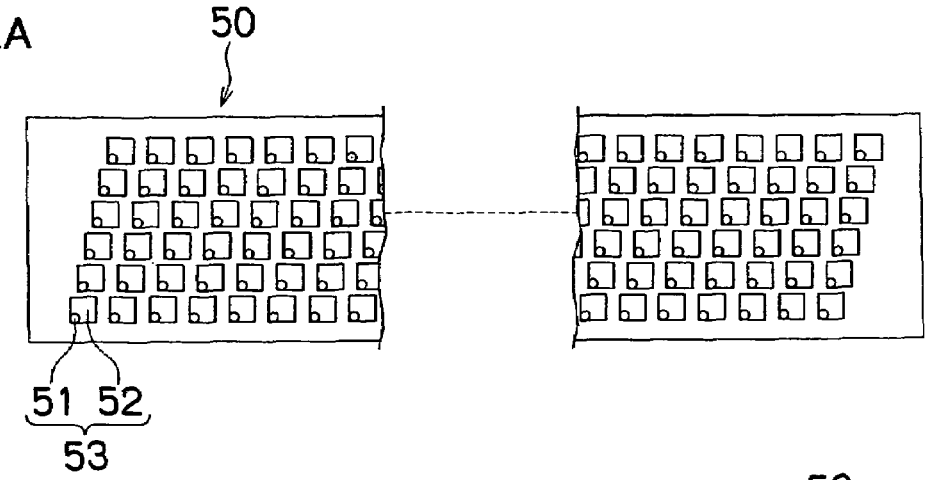
FIG. 2A is a perspective plan view showing an example of the configuration of the print head.
Figure 2B:
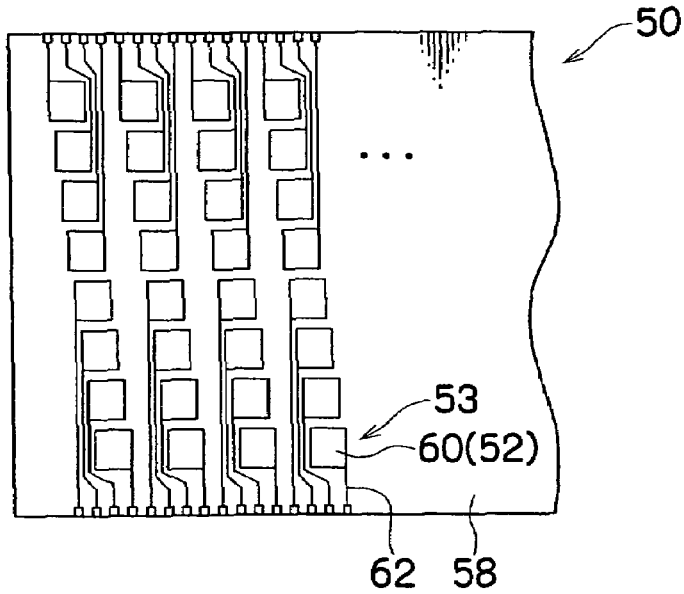
FIG. 2B is an enlarged wiring diagram showing the electrodes of the print head.
Figure 2C:
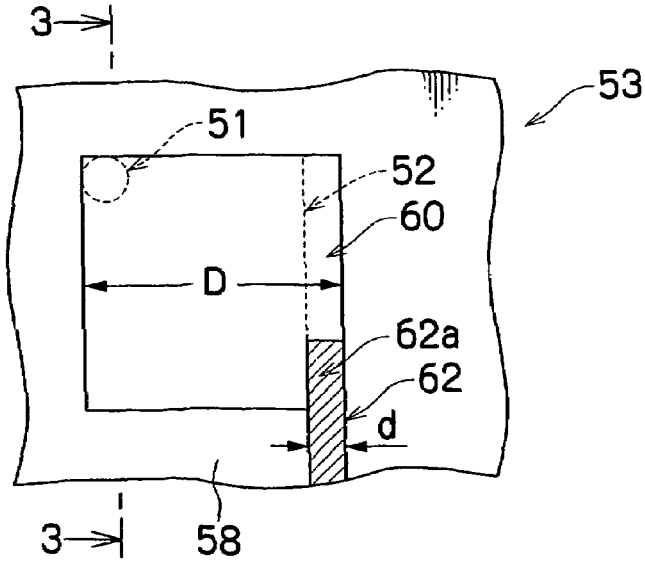
FIG. 2C is a partial enlarged view of FIG. 2B.

FIG. 2A is a perspective plan view showing an example of the configuration of the print head 50, FIG. 2B is an enlarged wiring diagram showing the electrodes of the print head 50, and FIG. 2C is a partial enlarged view of FIG. 2B. The nozzle pitch in the print head 50 should be minimized in order to maximize the density of the dots printed on the surface of the recording paper. As shown in FIGS. 2A, 2B and 2C, the print head 50 in the present embodiment has a structure in which a plurality of ink chamber units 53 including nozzles 51 for discharging ink-droplets and pressure chambers 52 connecting to the nozzles 51 are disposed in the form of a staggered matrix, and the effective nozzle pitch is thereby made small. The planar shape of the pressure chamber 52 provided for each nozzle 51 is substantially a square, and the nozzle 51 is disposed in a corner on a diagonal line of the square.

Thus, the print head 50 is a full line head having one or more rows of nozzles in which a plurality of nozzles 51 which discharge ink are arranged across a length corresponding to the entire width of the recording medium in the direction substantially orthogonal to the delivery direction of the recording medium. In FIG. 2A, six rows of nozzles are displayed, and eight rows of nozzles are displayed in FIG. 2B.

A detailed description is provided later, but a discrete electrode 60 is formed on the pressure chamber 52 shown by the dashed line in FIG. 2C, the electrode is formed with a greater size than the chamber, and the tip 62' of a discrete lead electrode 62 is joined to the discrete electrode 60 in the area (the area in which the aperture of the pressure chamber 52 does not exist) in which the pressure chamber 52 is not disposed below the discrete electrode 60.

Figure 3:
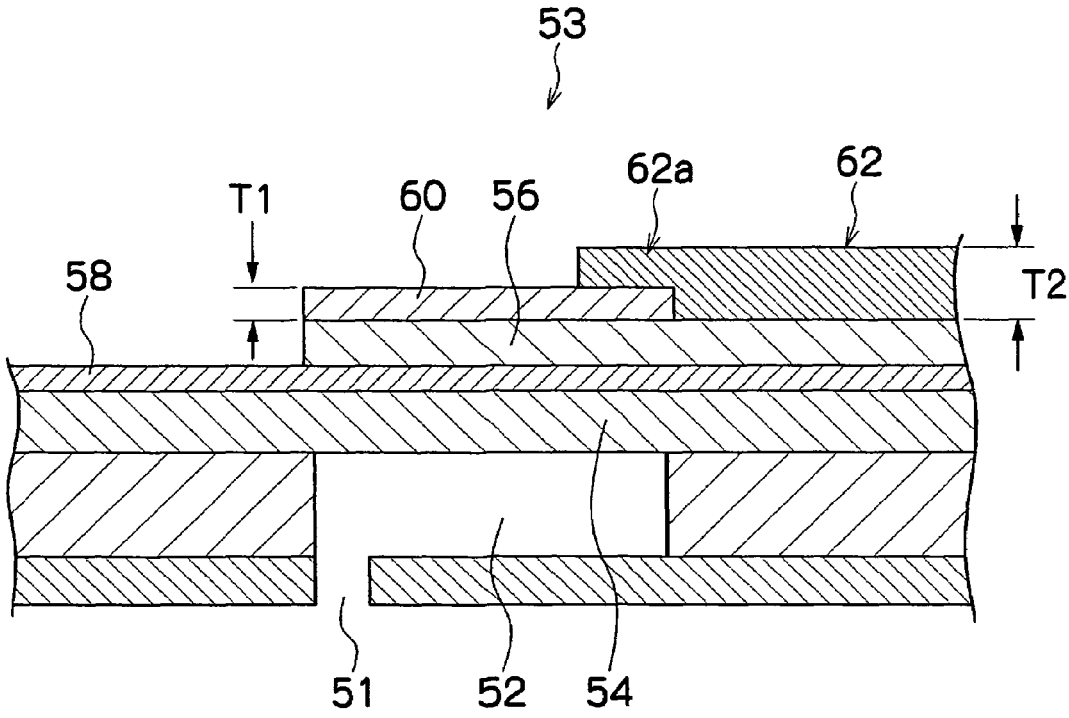
FIG. 3 is a cross-sectional view along the line 3-3 in FIG. 2.

FIG. 3 shows the appearance of the ink chamber unit 53 which is cut along the chain line 3-3 in FIG. 2C, and is viewed from the left side of FIG. 2C. As shown in FIG. 3, the ink chamber unit 53 is composed of a pressure chamber 52 having a nozzle 51, a diaphragm 54 constituting the top face of the pressure chamber 52, a piezoelectric element (piezoelectric actuator) 56 which is formed with a PZT film to press the diaphragm 54, a common electrode (lower electrode) 58 which are disposed below the piezoelectric element 56, and a discrete electrode (upper electrode) 60 which are disposed above the piezoelectric element 56. Although not included in the cross section in FIG. 3, the discrete lead electrode 62 (wiring portion) for supplying electricity to the discrete electrode 60 is joined in the upper rearward area in a manner whereby the tip 62' of the electrode is partially mounted on the discrete electrode 60.

In this example as shown in FIGS. 2B and 3, the diaphragm 54 and the common electrode 58 are formed as two common substrates onto all the pressure chambers 52, the piezoelectric element 56, and the discrete electrode 60 are formed on each pressure chamber 52, and a plurality of ink chamber unit 53 are formed.

The piezoelectric element 56 is deformed by applying a drive voltage to the discrete electrode 60 by way of the discrete lead electrode 62, the diaphragm 54 is bent toward the pressure chamber 52 as the piezoelectric element 56 presses the diaphragm 54, the volume of the pressure chamber 52 decreases as a result, and the ink inside the pressure chamber 52 is discharged from the nozzle 51. When the ink is discharged, new ink is supplied to the pressure chamber 52 by way of the common flow channel and ink supply port (not shown).

Figure 4:
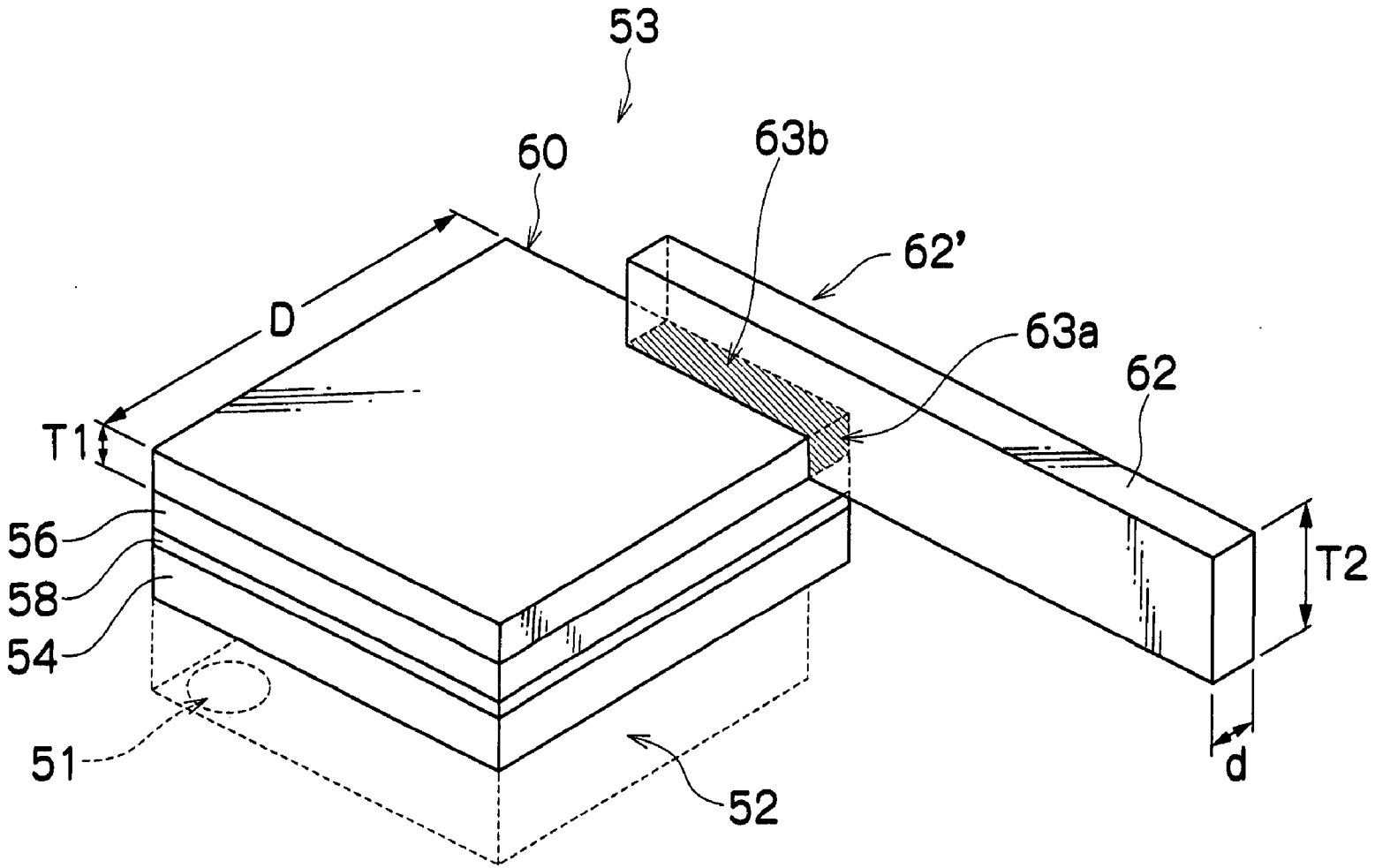
FIG. 4 is a perspective view of the ink chamber unit in FIG. 2C.

The ink chamber unit 53 shown in FIGS. 2C and 3 is shown in the perspective diagram of FIG. 4 in order to make the appearance of the joint between the discrete lead electrode 62 and discrete electrode 60 more readily apparent. FIG. 4 shows solely the portions of the diaphragm 54, common electrode 58, and other components corresponding to the pressure chamber 52. The substrate forming the side walls of the pressure chamber 52 and the nozzle 51 are omitted in FIG. 4 to make the joint between the discrete electrode 60 and discrete lead electrode 62 more readily apparent. The size of the discrete electrode 60 is larger than the pressure chamber 52 by an amount equal to the width of the discrete lead electrode 62 (to the right rearward width shown by the arrow "d" in FIG. 4), as shown in FIG. 2C.

The discrete lead electrode 62 is configured so that the tip 62' thereof is joined to the discrete electrode 60 at the portion (in the area in which the aperture of the pressure chamber 52 does not exist below this portion) of the discrete electrode 60 where the size is greater than the pressure chamber 52 while the pressure chamber 52 is not disposed below the discrete lead electrode 62. In other words, the discrete lead electrode 62 is configured so as to not overlap the aperture of the pressure chamber 52. Since the discrete lead electrode 62 does not overlap the aperture of the pressure chamber 52, the displacement of the piezoelectric element 56 and pressure chamber 52 is not restrained.

Furthermore, the discrete lead electrode 62 is thickly formed on the side opposite (on the upward side in FIGS. 3 and 4) from the aperture direction of the pressure chamber 52, and the discrete lead electrode 62 is joined to the discrete electrode 60 at two joint faces 63*a* and 63*b*, as shown in FIG. 4. Therefore, it is possible to increase the connective cross-sectional area, to reduce the connective resistance, and to increase the connective strength.

Also, it is possible to reduce the width "d" of the discrete lead electrode 62 by increasing the thickness "T2" thereof. As shown in FIG. 2B, since it is advantageous for wiring in a matrix when ink chamber units 53 are arranged in the form of a matrix, it is possible to make wiring on the side face thereof. Therefore, it is possible to thereby attain a higher density of nozzles 51.

In the present embodiment, the width, thickness, and other dimensions of the discrete electrode 60 and discrete lead electrode 62 are specifically defined below.

In other words, "D" is the width of the discrete electrode 60 in the same direction as the width direction of the discrete lead electrode, and d is the width of the discrete lead electrode 62, as shown in FIGS. 2C and 4. "T1" is the thickness of the discrete electrode 60, and "T2" is the thickness of the discrete lead electrode 62, as shown in FIGS. 3 and 4.

Here, the relationship between the thickness T1 of the discrete electrode 60 and the thickness T2 of the discrete lead electrode 62 is defined in the following formula (5).

$$T1 \leqq T2 \tag{5}$$

Also, the aspect ratio of the width D and thickness T1 of the discrete electrode 60 is defined by the following formula (6).

$$\frac{T1}{D} \geq \frac{1}{1000} \tag{6}$$

Also, the aspect ratio of the width d and thickness T2 of the discrete lead electrode 62 is defined by the following formula (7).

$$\frac{T2}{d} \geq 2 \tag{7}$$

Thus, it is preferable from the viewpoint of ensuring both higher density and the desired wiring resistance that the thickness T1 of the discrete electrode 60 is $$\frac{1}{1000}$$

or greater than the width D thereof (short width), and that the thickness T2 of the discrete lead electrode 62 is double or greater than the width d thereof.

Figure 5A:
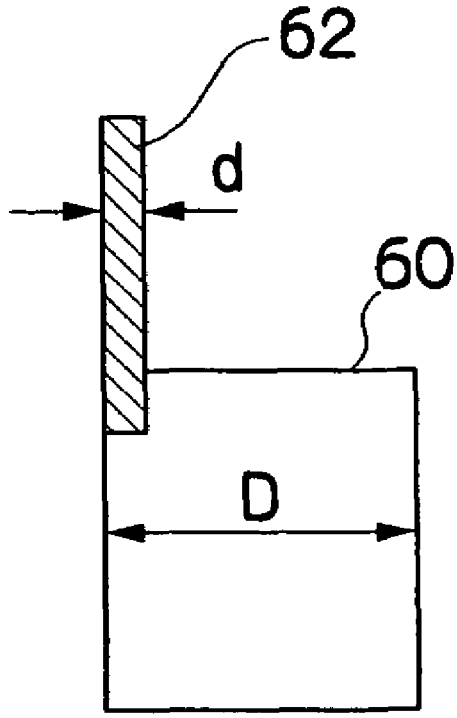
FIG. 5A is a plan view of a discrete electrode and a discrete lead electrode.
Figure 5B:
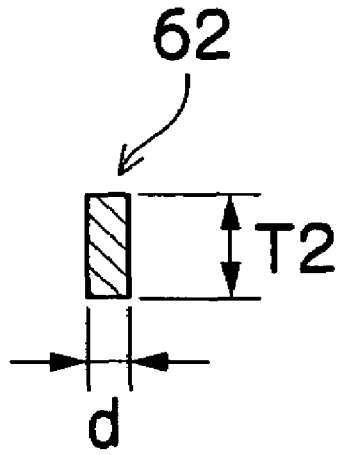
FIG. 5B is a cross-sectional view of the discrete lead electrode.
Figure 5C:
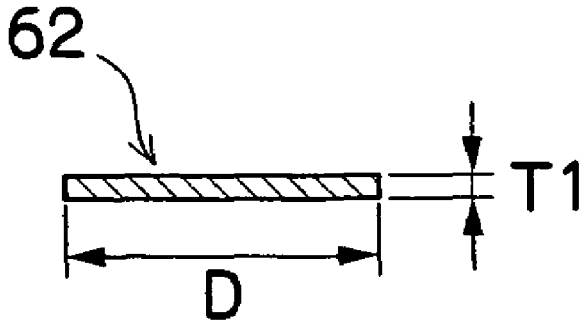
FIG. 5C is a cross-sectional view of the discrete electrode.

A summary of the above is shown in FIGS. 5A to 5C. FIG. 5A is a plan view of a discrete electrode 60 and a discrete lead electrode 62. As shown in FIG. 5A, "d" is the width of the discrete lead electrode 62, and "D" is the width of the discrete electrode 60. FIG. 5B is a cross-sectional view of the discrete lead electrode 62 as viewed from above in FIG. 5A. As shown in FIG. 5B, "d" is the width and T2 is the thickness of the discrete lead electrode 62. FIG. 5C is a cross-sectional view of the discrete electrode 60 as viewed from above in FIG. 5A. As shown in FIG. 5A, "T1" is the thickness of the discrete lead electrode 60.

A resistance value at or below the maximum permissible resistance value can be ensured with high density wiring by satisfying both formulas (6) and (7) as described above.

$$\frac{T1}{D} \geq \frac{1}{1000} \tag{6}$$

$$\frac{T2}{d} \geq 2 \tag{7}$$

Figure 6A:
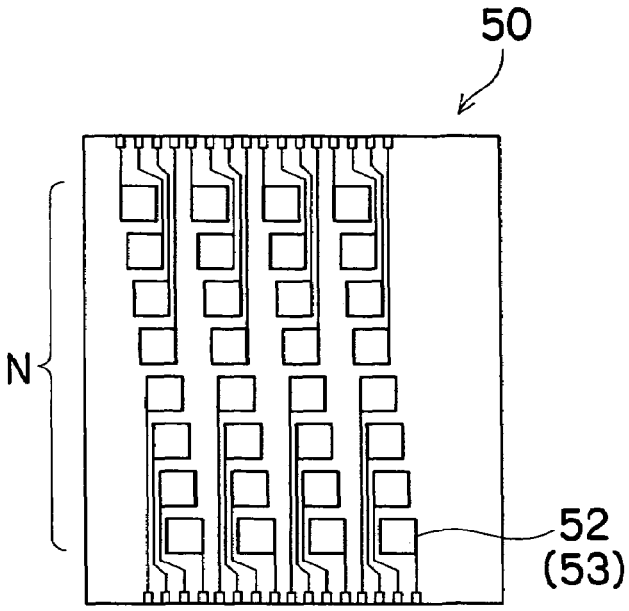
FIG. 6A is an enlarged view of the electrode wiring of a print head.
Figure 6B:
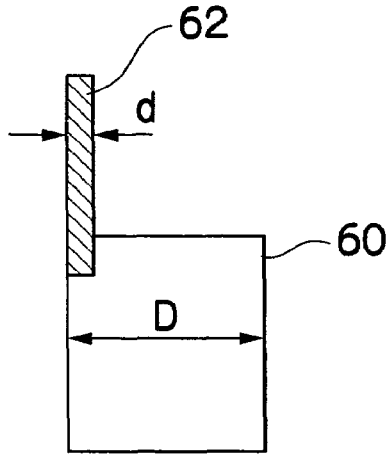
FIG. 6B is a plan view of a discrete electrode and another discrete lead electrode.

Also, "N" is the number of rows of pressure chambers 52 (ink chamber units 53) that are two-dimensionally arranged in the breadthways direction, as shown in FIG. 6A, "d" is the width of the discrete lead electrode 62, and "D" is the width (short width) of the discrete electrode 60 in the same direction therewith, as shown in FIG. 6B.

Here, the discrete electrode 60, the discrete lead electrode 62, and pressure chamber 52 are configured so as to satisfy the relationship defined by the following formula (8) between the width D (short width) of the discrete electrode 60, the width d of the discrete lead electrode 62, and the number N of rows of pressure chambers 52 in the breadthways direction.

$$\frac{D}{\left(\frac{N}{2}\right)} > d \tag{8}$$

In the example shown in FIG. 2B, the vertical direction is the breadthways direction, the horizontal direction is the lengthwise direction, eight pressure chambers 52 are arranged in the breadthways direction, the number of rows of pressure chambers 52 in the breadthways direction is N=8, and above formula (8) is $$\frac{D}{4} > d.$$

In this example, therefore, the width d of the discrete lead electrode 62 is set to less than $$\frac{1}{4}$$

the width D of the discrete electrode 60. Shorting is prevented between discrete lead electrodes and a higher density configuration is made possible by setting the width d of the discrete lead electrode in this manner.

Figure 7A:
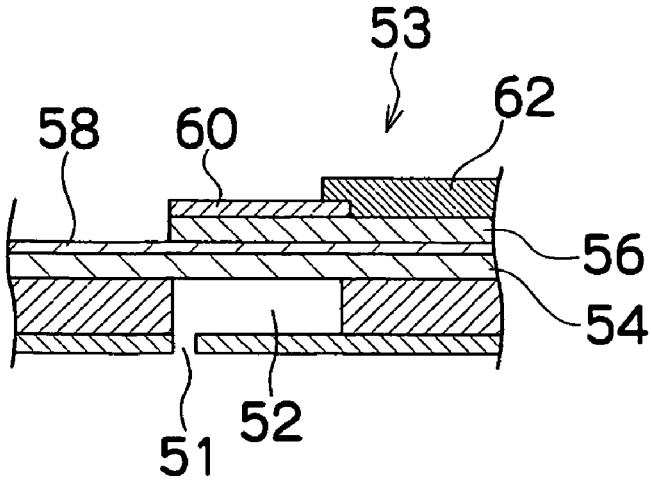
FIG. 7A is a cross-sectional view of a pressure chamber unit.
Figure 7B:
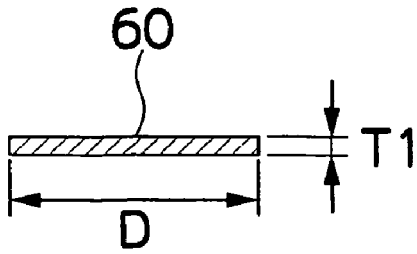
FIG. 7B is a cross-sectional view of a discrete electrode.
Figure 7C:
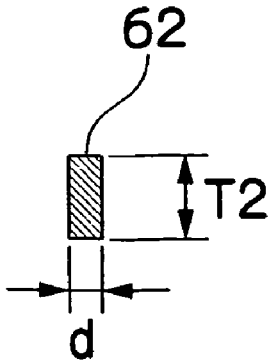
FIG. 7C is a cross-sectional view of a discrete lead electrode.

FIG. 7A cross-sectional view of the same pressure chamber unit 53 as in FIG. 3; a diaphragm 54, a common electrode 58, a piezoelectric element 56, and a discrete electrode 60 are formed above the pressure chamber 52 having a nozzle 51; and a discrete lead electrode 62 is brought out from discrete electrode 60. FIG. 7B is a side view of a discrete electrode 60 viewed from the left hand direction of FIG. 7A and provided with the width D and thickness T1. FIG. 7C is a side view for a discrete lead electrode 62 as viewed from the right hand direction of FIG. 7A and provided with the width d and thickness T2.

When "R" is the permissible resistance value (maximum resistance value permitted by the wiring) of a discrete lead electrode 62, "ρ" is the specific resistance of the material, and "L" is the lead length (wiring length) of a discrete lead electrode 62, ρ and T2 are configured so that the relationship defined in formula (9) is satisfied with respect to the above values, and to the thickness T2 and width d of the discrete lead electrodes 62.

$$\frac{\rho}{T2} \leq \frac{Rd}{L} \tag{9}$$

The wiring resistance of the discrete lead electrodes 62 can be set to a predetermined value or lower by setting the wiring resistance of the discrete lead electrodes 62 so as to satisfy formula (9).

Figure 8A:
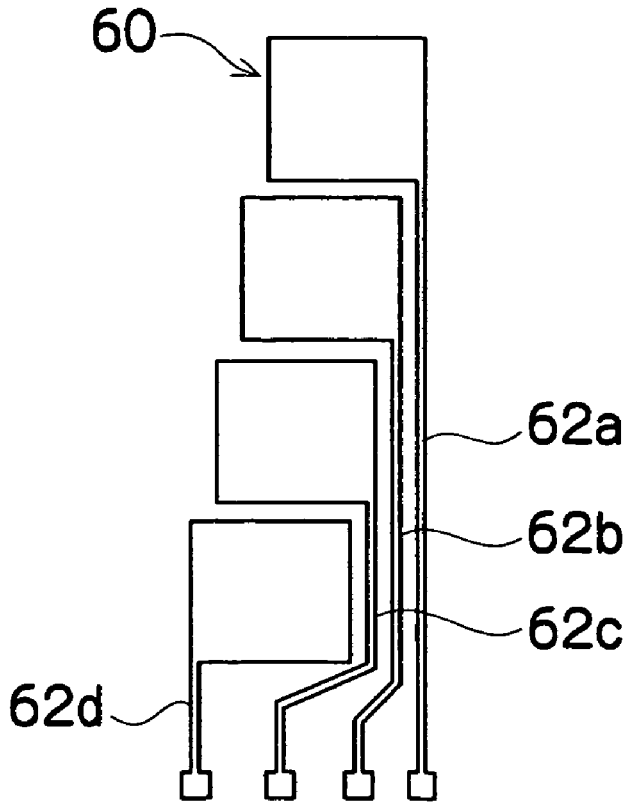
FIGS. 8A and 8B are diagrams showing the manner in which the thickness is varied in accordance with the length of the lead electrode wiring.
Figure 8B:
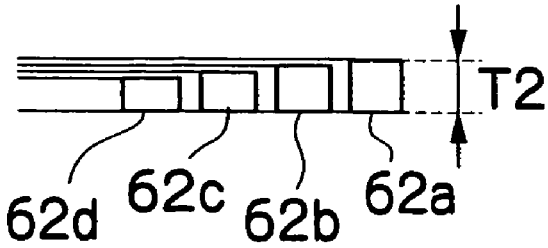

The thickness (height) T2 of the discrete lead electrodes 62 is preferably set so that the resistance values of the discrete lead electrodes 62 are equal. When the discrete lead electrodes 62*a*, 62*b*, 62*c*, and 62*d* are brought out from the discrete electrodes 60 with differing wiring lengths, as shown, for example, in FIG. 8A, the thickness (height) T2 thereof is increased to about that of the discrete lead electrode 62*a*, which has a long wiring length, as shown in FIG. 8B. Thus, the resistance value of the wiring is made to be equal to or less than the maximum resistance value by modifying the thickness (height) T2 in accordance with to the wiring length.

Figure 9A:
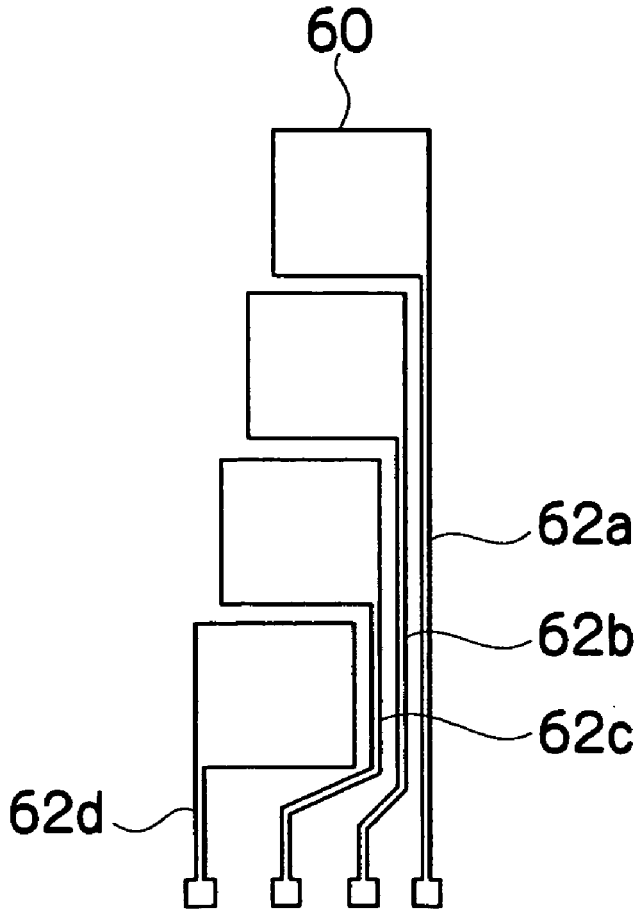
FIGS. 9A and 9B are cross-sectional views showing the manner in which the thicknesses of the lead electrodes are made uniform.
Figure 9B:
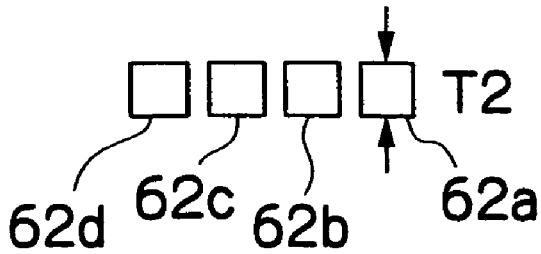

The thickness (height) T2 of the discrete lead electrodes 62 may be made uniform at the resistance value corresponding to the discrete lead electrode 62 with the longest wiring length. For example, when the discrete lead electrodes 62*a*, 62*b*, 62*c*, and 62*d* are brought out from the discrete electrodes 60 with differing wiring lengths as shown in FIG. 9A, the maximum resistance value can be ensured by making the thicknesses of the discrete lead electrodes 62*a*, 62*b*, 62*c*, and 62*d* uniform with the thickness (height) T2 of the discrete lead electrode 62*a* with the longest wiring length as shown in FIG. 9B.

As described above, lead electrodes for a nozzle head with a two-dimensional high-density array can be realized, and the desired lead electrode resistance can brought about by forming pressure chambers 52, discrete electrodes 60, and discrete lead electrodes 62.

Next, the manufacturing method of such a print head (inkjet head) 50 is described. First, an aerosol method used in the present manufacturing method is described.

Figure 10:
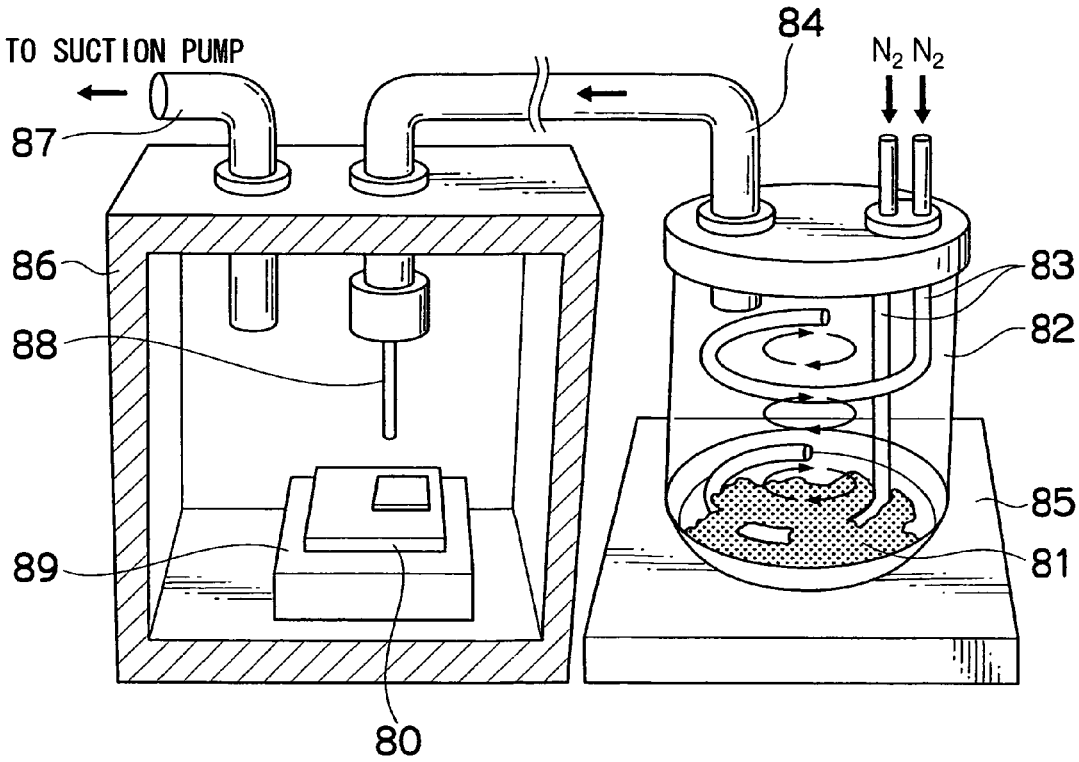
FIG. 10 is a perspective view showing the outline of the film production apparatus based on the aerosol method.

FIG. 10 shows a schematic diagram of a film production apparatus based on an aerosol method. The film production apparatus has an aerosol generator 82 which receives a raw material powder 81. As used herein, the term "aerosol" refers to solid or liquid fine particles suspended in a vapor.

The aerosol generator 82A comprises a carrier gas inlet 83, an aerosol outlet 84, and a vibrating unit 85. The raw material powder 81 stored in the aerosol generator 82 is blown upward when nitrogen gas ($N_2$) or another gas is introduced through the carrier gas inlet 83, generating an aerosol. In this case, the raw material powder 81 is agitated by imparting a vibration to the aerosol generator 82 with the vibrating unit 85, and an aerosol is efficiently generated. The generated aerosol passes through the aerosol outlet 84 and is brought to the film formation chamber 86.

The film formation chamber 86 comprises an exhaust tube 87, a nozzle 88, and a movable stage 89. The exhaust tube 87 is connected to a vacuum pump and is used to remove the gas from the film formation chamber 86. The aerosol generated in the aerosol generator 82 and brought to the film formation chamber 86 via the aerosol outlet 84 is sprayed from the nozzle 88 toward the substrate 80. Therefore, the raw material powder 81 collides with the substrate 80 and is deposited thereon. The substrate 80 is placed on the movable stage 89, which is capable of moving in three dimensions, and the relative position of the substrate 80 with respect to the nozzle 88 is adjusted by controlling the moveable stage 89.

FIGS. 11A to 11J show the sequential steps of a manufacturing method of a print head 50. The manufacturing method shown in FIGS. 11A to 11J mechanically separates and creates independent piezoelectric elements for each pressure chamber, and is referred to as a mechanical separation method.

Figures 11G, 11H, 11I, 11J:
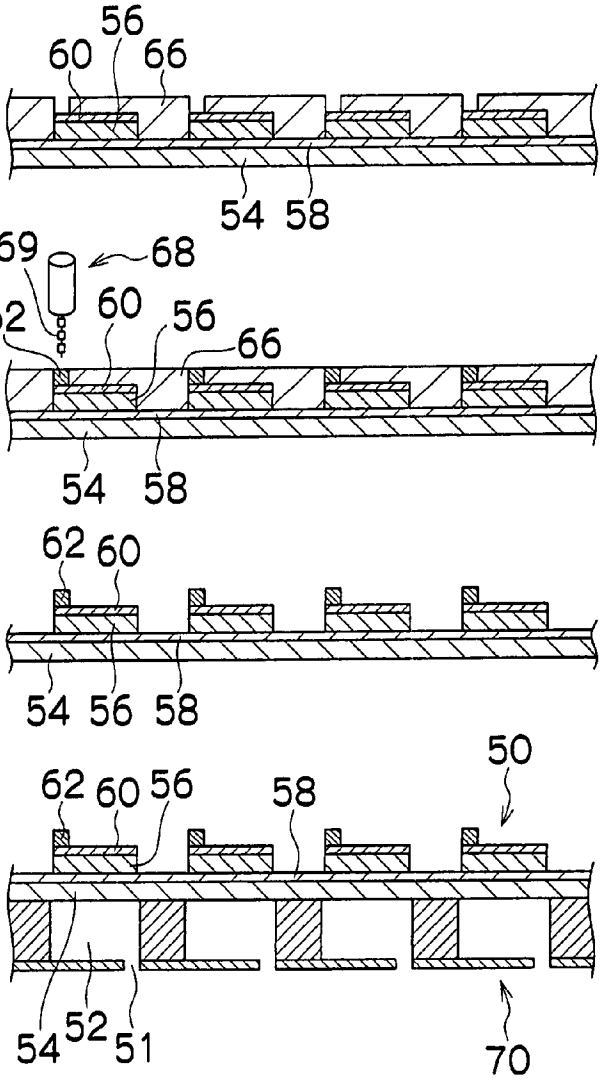
FIGS. 11A to 11J are cross-sectional views showing the sequential steps in a method of manufacturing a print head.
Figures 11A, 11B, 11C, 11D, 11E, 11F:
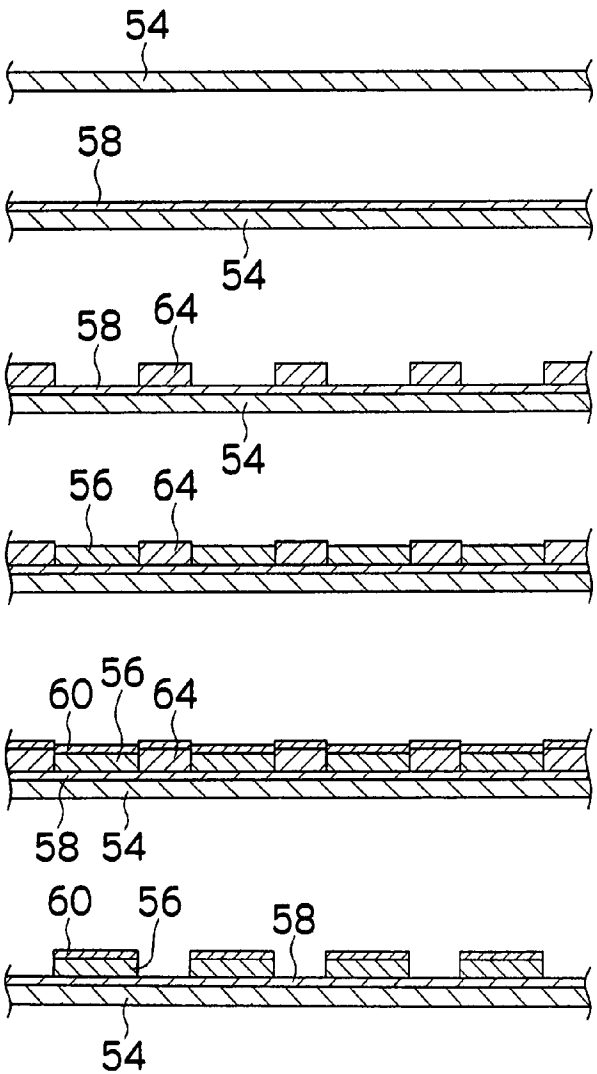

First, a single SUS substrate to serve as a diaphragm 54 is prepared as shown in FIG. 11A, and a platinum/titanium oxide ($Pt/TiO_2$) is formed as a common electrode 58 by sputtering on the diaphragm 54 composed of the SUS substrate as shown in FIG. 11B. Next, a resist is applied to form a mask (resist mask) 64 in order to fashion piezoelectric elements 56 as shown in FIG. 11C. Then, as shown in FIG. 11D, the piezoelectric elements 56 are fashioned by forming a piezo (PZT) film by sputtering method, laser ablation method, CVD method, or the aerosol method.

Next, a gold (Au) film to serve as discrete electrodes 60 is formed thereon by sputtering or the aerosol method as shown in FIG. 11E. Then, as shown in FIG. 11F, by removing the resist mask 64 and the film of the discrete electrodes 60 formed in areas except for areas of the piezoelectric elements 56, the piezoelectric elements 56 and discrete electrodes 60 are formed in positions corresponding to the pressure chambers 52 on the diaphragm 54 and common electrode 58, which constitute a single substrate.

Subsequently, the resist mask 66 is formed in areas except for the wiring portion in order to form discrete lead electrodes 62, as shown in FIG. 11G In the step shown in FIG. 11H, fine particle powder 69 in the form of an aerosol is sprayed from the nozzle 68 (corresponding to the nozzle 88 in the film production apparatus of FIG. 10) by using a film production apparatus of the aerosol method such as that described in FIG. 10, and then the discrete lead electrodes 62 are formed by the aerosol method.

Next, after the resist mask 66 is lifted off and removed as shown in FIG. 11I, and post-annealing is carried out at about 600° C. Then, the common electrode 58, piezoelectric elements 56, discrete electrodes 60, and discrete lead electrodes 62 are formed in this manner on a substrate (diaphragm 54). Therefore, as shown in FIG. 11J, the print head (inkjet head) 50 is completed by joining a substrate 70 provided with pressure chambers 52 having nozzles 51 and ink channels (not shown) which supply ink to the pressure chambers 52.

In the above-described manufacturing method, the films are formed by sputtering or the aerosol method in the step for forming the piezoelectric elements 56 shown in FIG. 11D, and in the step for forming the discrete electrodes 60 shown in FIG. 11E. However, at least one element selected from the piezoelectric elements 56 and discrete electrodes 60 is preferably formed by the aerosol method.

Figure 12A:
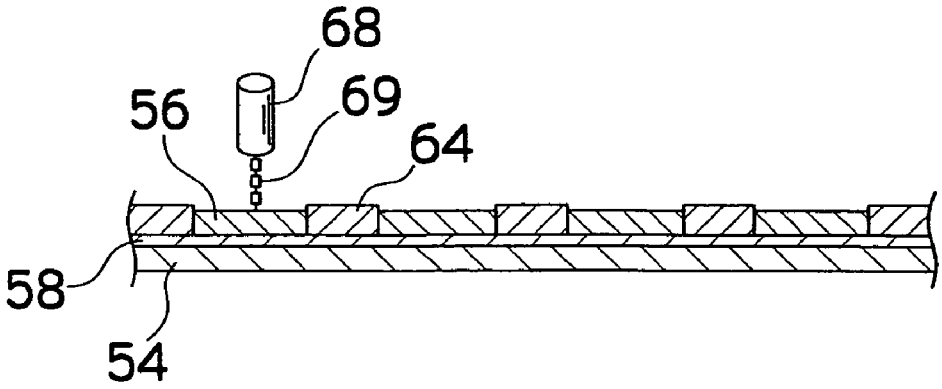
FIG. 12A is a cross-sectional view showing the manner in which a piezoelectric element is formed by the aerosol method.

FIG. 12A shows the formation of piezoelectric elements 56 by the aerosol method. As shown in FIG. 12A, the resist mask 64 is formed on the common electrode 58, and fine particle powder 69 in the form of an aerosol is thereafter sprayed from the nozzle 68 of the film production apparatus (not shown) based on the aerosol method to form the piezoelectric elements 56 by the aerosol method.

Figure 12B:
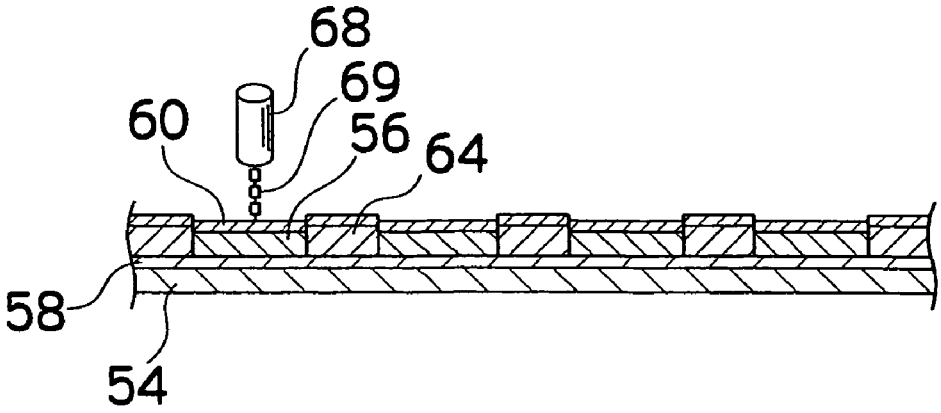
FIG. 12B is a cross-sectional view showing the manner in which a discrete electrode is formed by the aerosol method.

FIG. 12B shows the formation of discrete electrodes 60 by the aerosol method in the same manner. The fine particle powder 69 in the form of an aerosol is sprayed from the nozzle 68, as shown in FIG. 12B, to form the discrete electrodes 60 on the piezoelectric elements 56.

Figure 13:
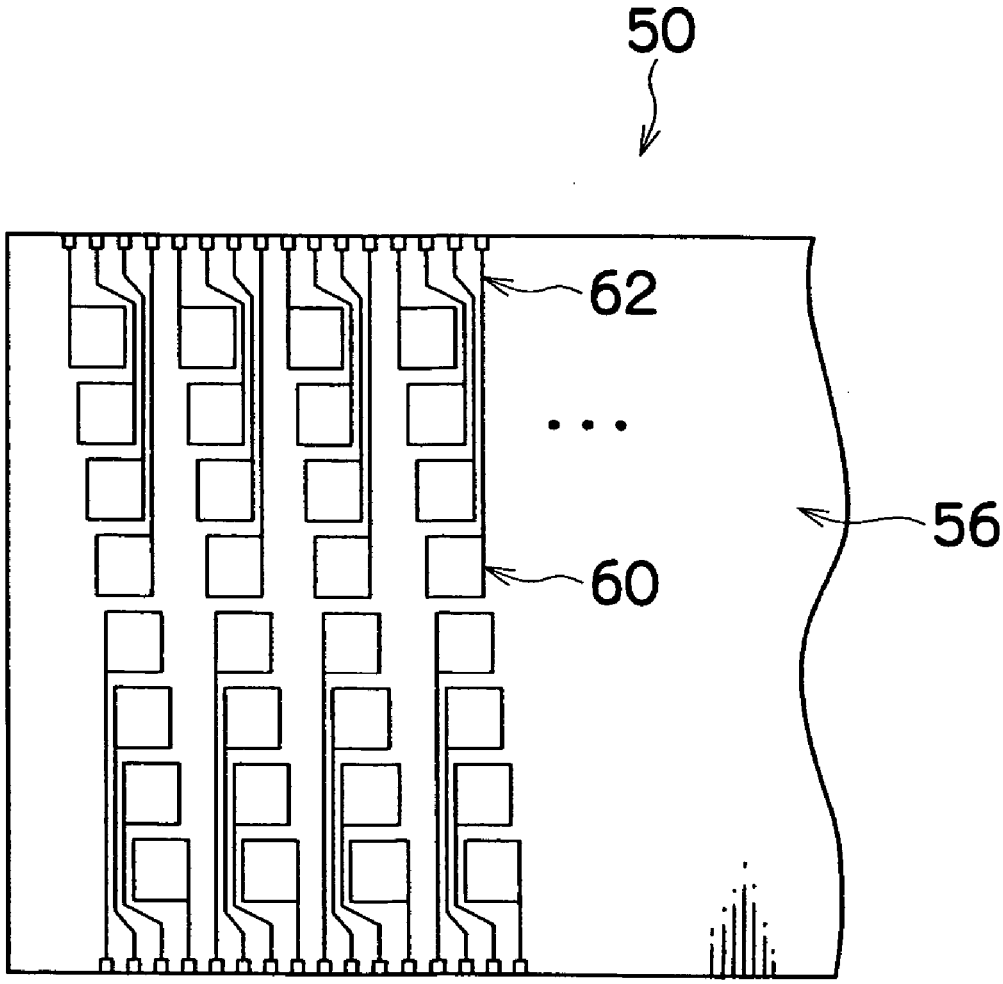
FIG. 13 is a plan view showing the schematic configuration of another example of a print head.

Next, another manufacturing method for a print head 50 is described. This method entails forming not only the diaphragm 54 and common electrode 58, but also the piezoelectric elements 56 as a single film that is common to all the pressure chambers 52, as shown in FIG. 13, and forming discrete electrodes 60 corresponding to the pressure chambers 52 (not shown in FIG. 13) as a single film, as shown in FIG. 13. The ink chamber units 53 are separated by the discrete electrodes 60 in the so-called electrode separation method.

FIGS. 14A to 14J show the sequential steps of a manufacturing method of a print head 50 formed by the electrode separation method, which piezoelectric elements are formed in common across a plurality of pressure chambers, and discrete electrodes are mechanically separated and made independent from each pressure chamber.

First, a single SUS substrate to serve as the diaphragm 54 is prepared as shown in FIG. 14A, and a $Pt/TiO_2$ film to serve as the common electrode 58 is formed on the diaphragm 54 composed of the SUS substrate as shown in FIG. 14B. Piezoelectric elements 56 composed of a single film are formed thereon in common with all of the pressure chambers 52 by forming a piezo (PZT) film with a thin film forming device or the aerosol method, as shown in FIG. 14C.

Next, a resist is applied to areas except for areas in which discrete electrodes 60 are to be formed, and a resist mask 72 is formed in order to fashion discrete electrodes 60 in positions corresponding to the pressure chambers 52, as shown in FIG. 14D. A gold (Au) fine particle powder 69 in the form of an aerosol is sprayed from the nozzle 68 to the open portions 72*a* of the resist mask 72, a film is deposited, and discrete electrodes 60 are formed by the aerosol method, as shown-in FIG. 14E.

Next, when the above resist mask 72 is lifted off and removed as shown in FIG. 14F, a resist mask 66 which forms the discrete lead electrodes 62 is formed as shown in FIG.

14G. Then, the fine particle powder 69 in the form of an aerosol is sprayed from the nozzle 68 to form discrete lead electrodes 62 by the aerosol method, as shown in FIG. 14H.

Next, after the resist mask 66 is lifted off and removed as shown in FIG. 14I, post-annealing is carried out at about 600° C. In this manner, after the common electrode 58 and piezoelectric elements 56 are formed as a single film on the substrate (diaphragm 54), the discrete electrodes 60 and discrete lead electrodes 62 are formed thereon. Therefore, as shown in FIG. 14J, the print head (inkjet head) 50 is completed by joining a substrate 70 provided with pressure chambers 52 having nozzles 51, ink channels (not shown) for supplying ink to the pressure chamber 52, and the like.

Next, yet another manufacturing method of a print head 50 is described. This method entails layering the diaphragm 54, the common electrode 58, the piezoelectric elements 56, and the discrete electrodes 60 so as to form a film across the entire surface; and then forming a pattern that extends all the way to the piezoelectric elements 56 by using a resist mask to separate and form the discrete electrodes 60.

FIGS. 15A to 15H show the sequential steps of the method of manufacturing the print head 50 in accordance with the present method. This method entails forming at least one element selected from the piezoelectric elements 56 and discrete electrodes 60 by the aerosol method.

Figure 15A:
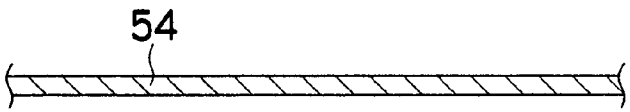
FIGS. 15A to 15H are diagrams showing the sequential steps in another method of manufacturing a print head.
Figure 15B:
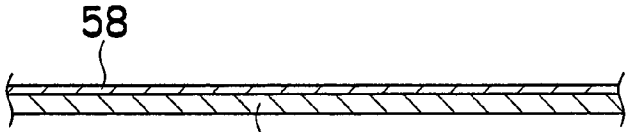
Figure 15C:
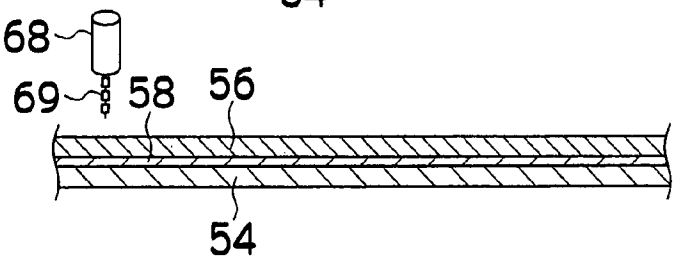
Figure 15D:
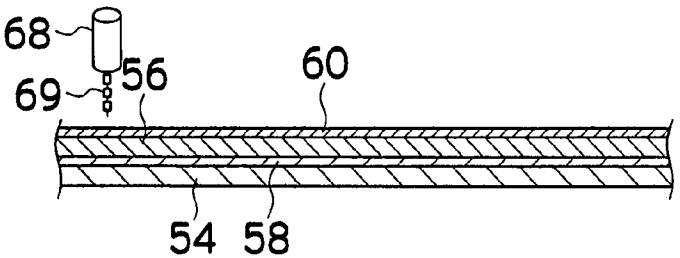

First, a single SUS substrate to serve as the diaphragm 54 is prepared, as shown in FIG. 15A, and a Pt/$TiO_2$ film to serve as the common electrode 58 is formed thereon by sputtering, as shown in FIG. 15B. Then, the fine particle powder 69 in the form of an aerosol is sprayed thereon from the nozzle 68 using the aerosol method to form a PZT film for the piezoelectric elements 56, as shown in FIG. 15C. Also, as shown in FIG. 15D, the fine particle powder 69 in the form of an aerosol is sprayed thereon in the same manner from the nozzle 68 by using the aerosol method to form a gold (Au) film for the discrete electrodes 60. Here, both the piezoelectric elements 56 and the discrete electrodes 60 are described as being formed by the aerosol method, but at least one of the piezoelectric elements 56 and the discrete electrodes 60 may be formed by the aerosol method.

Figure 15E:
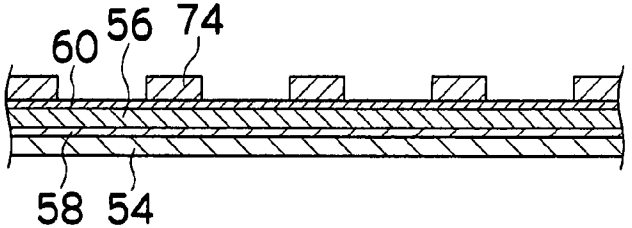
Figure 15F:
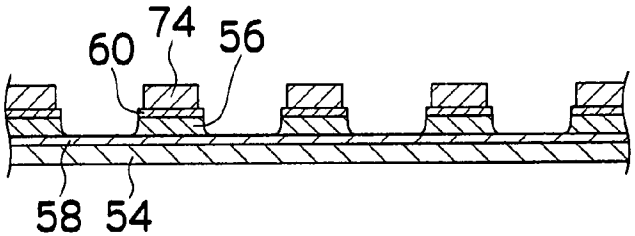

Next, as shown in FIG. 15E, a resist is applied to form as the resist mask 74 that serves to separate the discrete electrodes 60 into positions corresponding to the pressure chambers 52. Then, the portions devoid of the resist mask 74 are removed all the way up to the piezoelectric elements 56 by patterning based on ion milling, sandblasting, or another method, as shown in FIG. 15F, and the common electrode 58 is exposed.

Figure 15G:
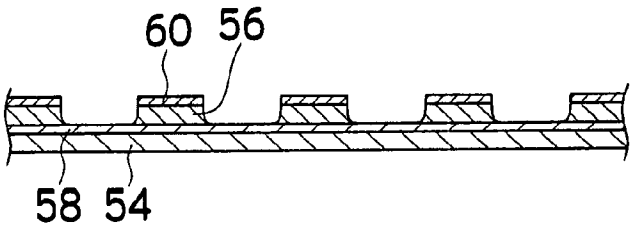

Next, the resist mask 74 is lifted off and removed, and the discrete electrode 60 and piezoelectric element 56 are separated and formed, as shown in FIG. 15G.

Figure 15H:
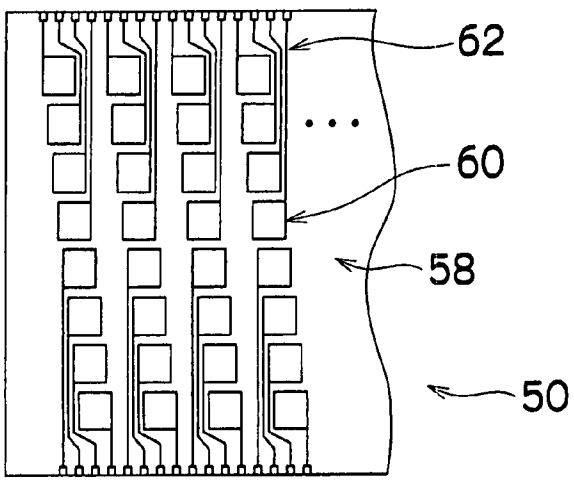

Then, the discrete lead electrodes 62 are formed for the discrete electrodes 60 as shown in the plan view of the print head 50 in FIG. 15H, and the print head 50 is completed by bonding the pressure chambers 52 (not shown) to the lower portion of the common electrode 58 (the diaphragm 54).

Next, a manufacturing method of elements in the thickness of the areas with the discrete lead electrodes 62 is described.

The method described first entails forming elements in the thickness of the discrete lead electrodes 62 by the nozzle scanning of the film production apparatus for performing the aerosol method without the use of a resist mask on the discrete electrodes 60.

Figure 16:
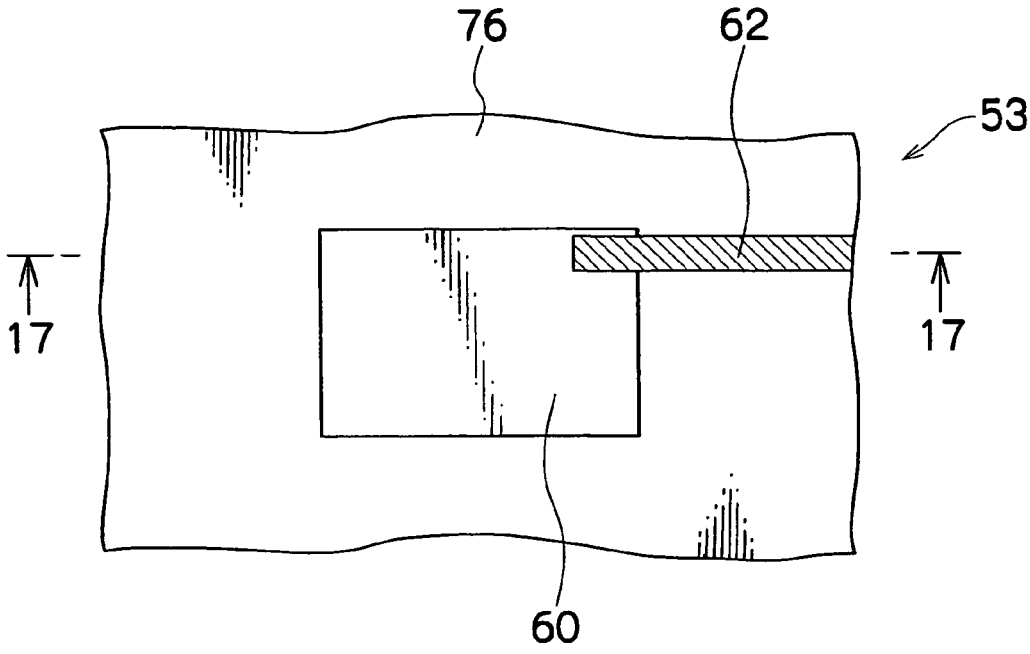
FIG. 16 is a plan view showing the method whereby the thickness of the discrete lead electrode is made thick.
Figure 17:
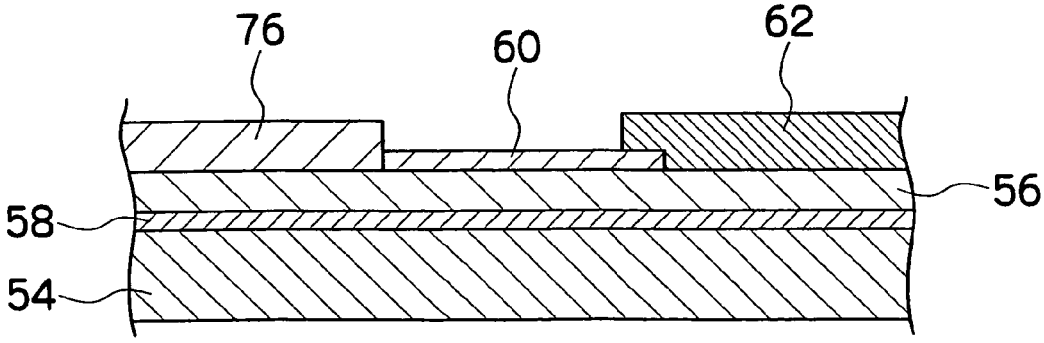
FIG. 17 is a cross-sectional view along the line 17-17 of FIG. 16.

FIG. 16 shows a plan view of a single ink chamber unit 53 during production with the present method, and FIG. 17 shows a cross-sectional view along the dotted line 17-17 of FIG. 16. In addition, FIG. 17 shows the area above the diaphragm 54.

As shown in FIGS. 16 and 17, a resist mask 76 is not formed on the discrete electrodes 60, and the discrete lead electrodes 62 are thickly formed by the nozzle scanning of the aerosol method so as to be partially mounted on the discrete electrodes 60.

The next described method entails thickly forming a resist mask in areas except for areas in which the discrete lead electrodes 62 are to be formed on the discrete electrodes 60, and forming the elements in the thickness of the area with the discrete lead electrodes 62.

Figure 18:
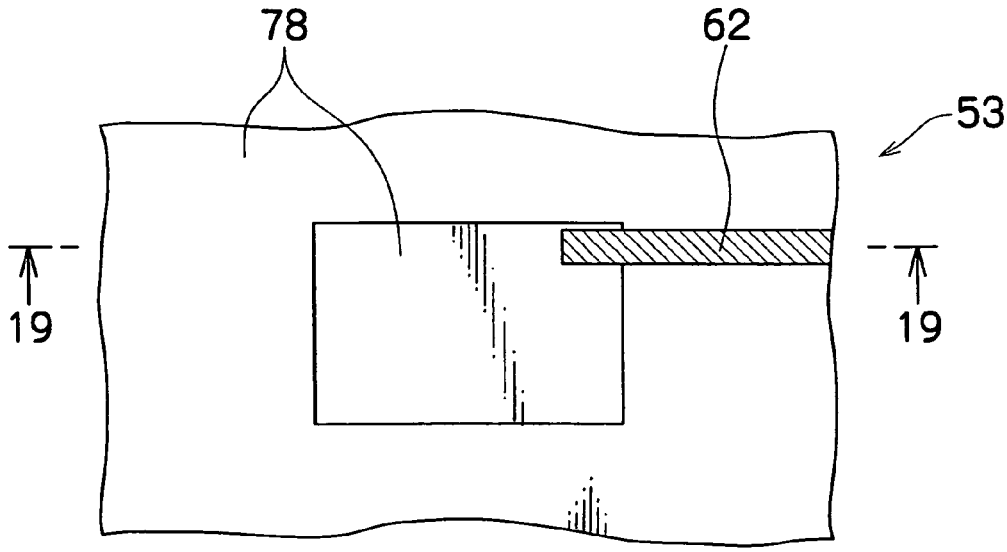
FIG. 18 is a plan view showing another method whereby the thickness of the discrete lead electrode is made thick.
Figure 19:
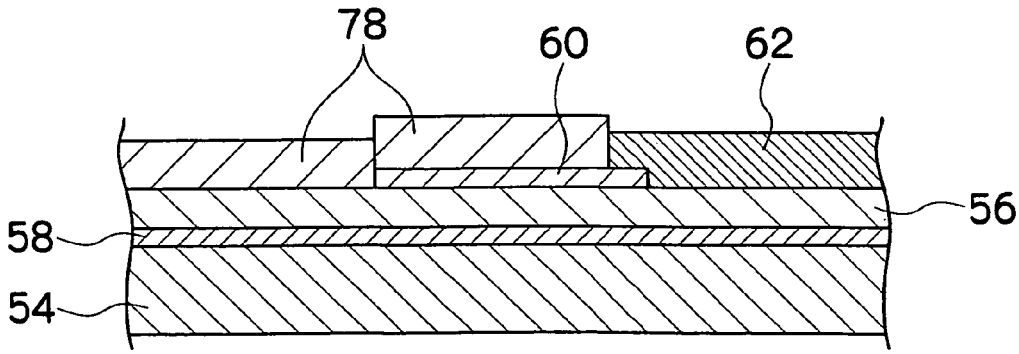
FIG. 19 is a cross-sectional view along the line 19-19 of FIG. 18.

FIG. 18 shows a plan view of a single ink chamber unit 53 during production by the present method, and FIG. 19 shows a cross-sectional view along the dotted line 19-19 of FIG. 18. In addition, FIG. 19 shows the area above the diaphragm 54 in the same manner as FIG. 17.

As shown in FIGS. 18 and 19, a thick resist mask 78 is formed in the areas except for the areas in which discrete lead electrodes 62 are to be formed, and the discrete lead electrode 62 is formed by the aerosol method. Thus, when a thick resist mask 78 is also disposed on the discrete electrode 60, and a discrete lead electrode 62 is formed by the aerosol method, a film that does not bleed can be formed on the discrete electrode 60, and the discrete lead electrode 62 can be formed solely on the portions devoid of a pressure chamber 52 (not shown).

In the examples described up to this point, a discrete lead electrode 62 such as that shown in FIG. 4 is formed so that the tip 62' thereof is partially mounted on the discrete electrode 60, but the shape of the discrete lead electrode 62 is not limited to those. A variety of aspects are possible.

Figure 20:
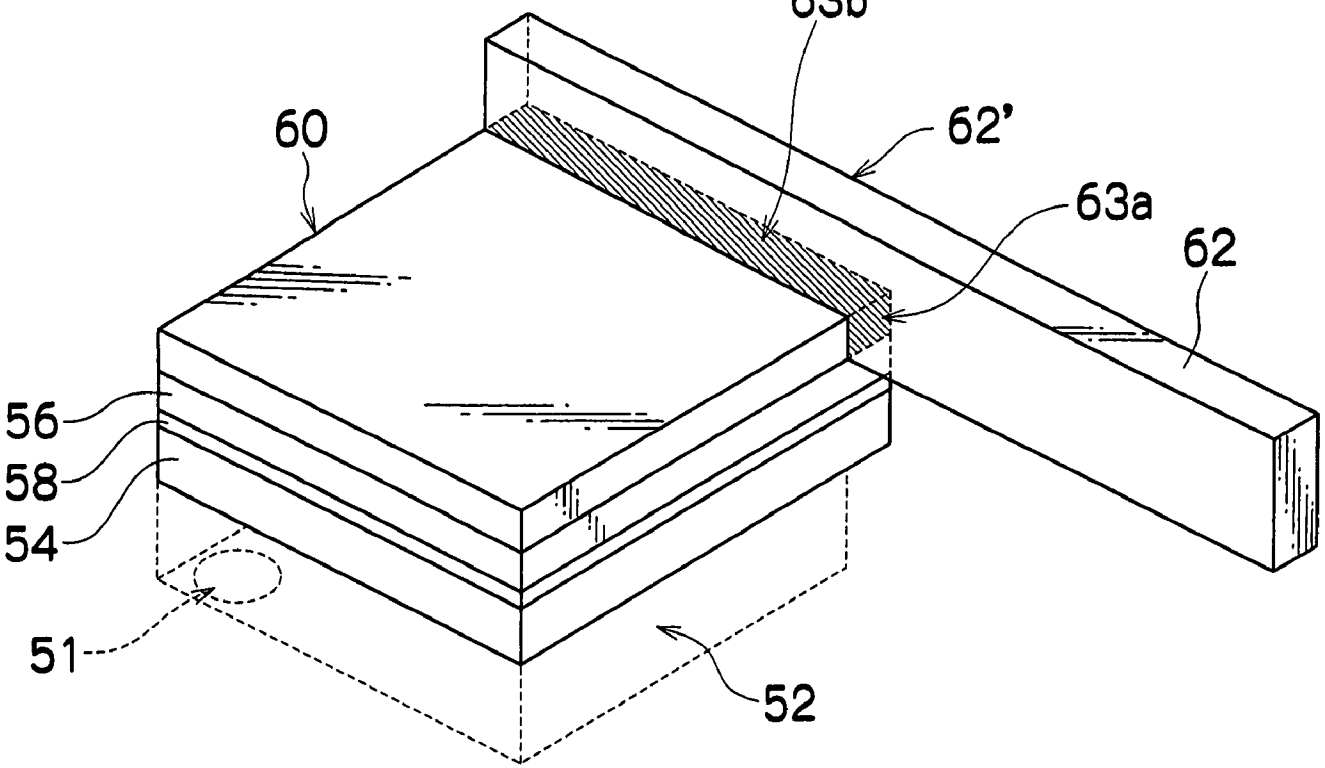
FIG. 20 is a perspective view of the ink chamber unit which shows another shape of the discrete lead electrode.

For example, the tip 62' of the discrete lead electrode 62 may be extended to the edge of the discrete electrode 60, as shown in FIG. 20. Therefore, it is possible to reduce the width of the discrete lead electrode 62 because the contact surface area between the discrete electrode 60 and discrete lead electrode 62 in the joined face 63b is increased.

Figure 21:
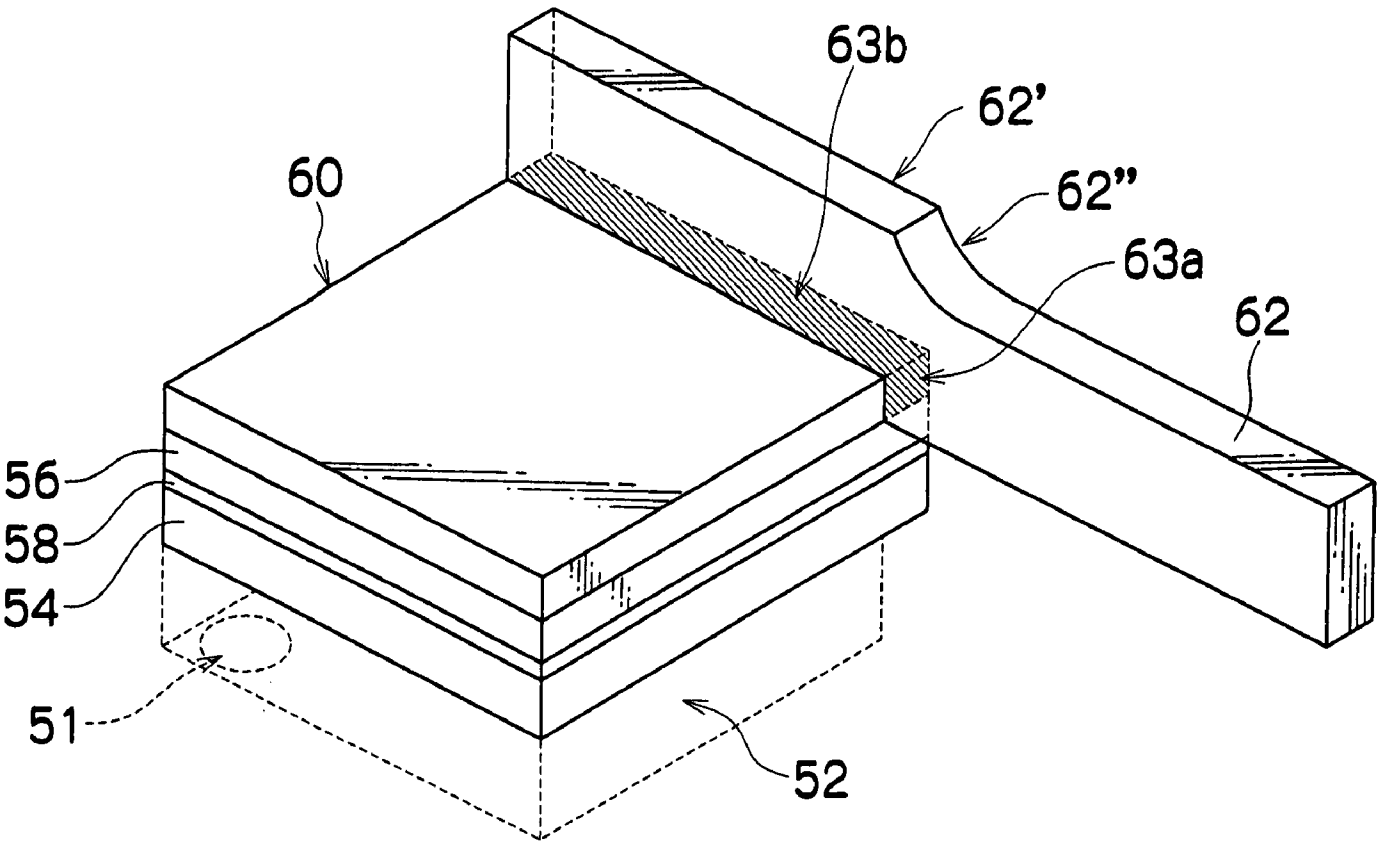
FIG. 21 is a perspective view of the ink chamber unit which shows yet another shape of the discrete lead electrode.

Also, a step 62" may be disposed between the area on the discrete electrode 60 occupied by the discrete lead electrode 62 and other the areas to make the thickness of the discrete lead electrode 62 constant overall, as shown in FIG. 21.

Figure 22:
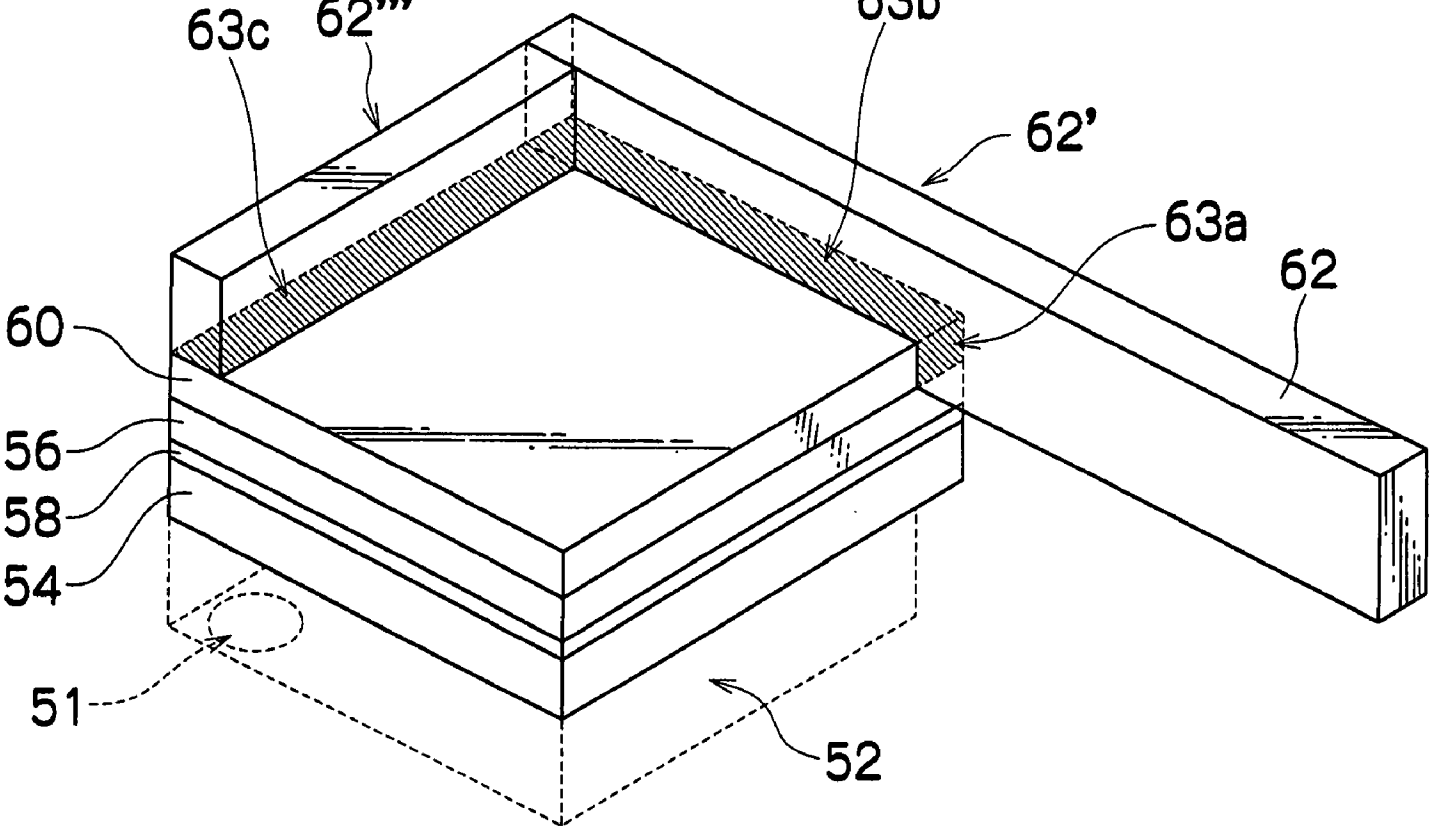
FIG. 22 is a perspective view of the ink chamber unit which shows still another shape of the discrete lead electrode.

As shown in FIG. 22, the tip 62' of the discrete lead electrode 62 may be extended, as indicated by the key symbol 62'", so as to enclose the outer periphery of the 60. Therefore, it is possible to increase the contact cross-sectional area, and to further reduce the width of the discrete lead electrode 62.

According to the present embodiment as described above, since it is possible to increase the thickness of the discrete electrode by forming a discrete lead electrode as the wiring portion by the aerosol method, the connective cross-sectional area with the discrete electrode can be increased and the electrode resistance can be decreased because the width of the wiring can be reduced. For this reason, since it is advantageous for disposing the pressure chambers with the form of a matrix, the wiring can be brought out from the side surface in a wiring arrangement of a matrix, and therefore higher density can be achieved.

Also, since a film can be formed in a non-contact manner by nozzle scanning in accordance with the aerosol method, it is possible to form the discrete lead electrode without a resist mask. In addition, the discrete lead electrode is formed on the discrete electrode so as to be thicker on the side opposite from the aperture direction of the pressure chamber. In particular, the displacement of the piezoelectric element can remain unrestrained by configuring the lead portion of the discrete lead electrode to avoid overlapping the aperture of the pressure chamber.

Furthermore, since it is possible to form the piezoelectric element, the discrete electrode, and the discrete lead electrode in the same chamber by the aerosol method, it is possible to simplify the manufacturing step of manufacturing for the inkjet head, and to reduce the manufacturing costs.

It should be understood, however, that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An inkjet head, comprising:

a plurality of ink discharge nozzles which are arranged two-dimensionally;

a plurality of pressure chambers which are in communication with the ink discharge nozzles so as to store ink, the pressure chambers being two-dimensionally arranged in correspondence with the ink discharge nozzles;

a plurality of piezoelectric elements;

a common electrode which is disposed on pressure chamber sides of the piezoelectric elements;

a plurality of discrete electrodes which are disposed on sides of the piezoelectric elements opposite to the common electrode; and a plurality of discrete lead electrodes which feed electricity to the discrete electrodes, wherein:

each of the piezoelectric elements is deformed by applying voltage to the common electrode and the discrete electrode so that a volume of the pressure chamber is varied to discharge a droplet of the ink from the ink discharge nozzle;

where thickness is defined as the shortest straight-line distance between any point on one surface and an opposite surface, with respect to each pair of the discrete electrode and discrete lead electrode corresponding to each of the pressure chambers, when T1 is a thickness of the discrete electrode and T2 is a thickness of the discrete lead electrode which feed electricity to the discrete electrode, the discrete electrode and the discrete lead electrode are configured so that T1 and T2 satisfy the following formula:

$$T1<T2; \text{ and further,}$$

wherein:

when D is a width of the discrete electrode in the same direction as a width of the discrete lead electrode, d is the width of the discrete lead electrode, and N is a number of rows in the breadthways direction of the two-dimensionally arranged pressure chambers, the discrete electrode, the discrete lead electrode, and the pressure chambers are configured so that the D, the d, and the N satisfy the following formula:

$$\frac{D}{\left(\frac{N}{2}\right)} > d \text{ where } N > 2.$$

2. The inkjet head as defined in claim 1, wherein each of the discrete lead electrodes is formed so as not to be overlaid in an aperture position of the pressure chamber.

3. The inkjet head as defined in claim 1, wherein the discrete lead electrode and the discrete electrode are formed so as to be connected at two surfaces of each other.

4. The inkjet head as defined in claim 1, wherein the discrete electrodes are formed by an aerosol method.

5. The inkjet head as defined in claim 1, wherein the discrete lead electrodes are formed by an aerosol method.

6. An inkjet head, comprising:

a plurality of ink discharge nozzles which are arranged two-dimensionally;

a plurality of pressure chambers which are in communication with the ink discharge nozzles so as to store ink, the pressure chambers being two-dimensionally arranged in correspondence with the ink discharge nozzles;

a plurality of piezoelectric elements;

a common electrode which is disposed on pressure chamber sides of the piezoelectric elements;

a plurality of discrete electrodes which are disposed on sides of the piezoelectric elements opposite to the common electrode; and a plurality of discrete lead electrodes which feed electricity to the discrete electrodes, wherein:

each of the piezoelectric elements is deformed by applying voltage to the common electrode and the discrete electrode so that a volume of the pressure chamber is varied to discharge a droplet of the ink from the ink discharge nozzle;

where thickness is defined as the shortest straight-line distance between any point on one surface and an opposite surface, with respect to each pair of the discrete electrode and discrete lead electrode corresponding to each of the pressure chambers, when T1 is a thickness of the discrete electrode and T2 is a thickness of the discrete lead electrode which feed electricity to the discrete electrode, the discrete electrode and the discrete lead electrode are configured so that T1 and T2 satisfy the following formula:

$$T1<T2; \text{ and further}$$

wherein:

when T2 is a thickness of the discrete lead electrode, d is a width of the discrete lead electrode, R is a permissible resistance value of the discrete lead electrode, ρ is a specific resistance of the discrete lead electrode, and L is a length of the lead of the discrete lead electrode, the thickness T2 and the specific resistance ρ of the discrete lead electrode are configured so that the T2 the d, the R, the ρ, and the L satisfy the following formula:

$$\frac{\rho}{T2} \leq \frac{Rd}{L}.$$

7. The inkjet head as defined in claim 6, wherein the thickness T2 of the lead electrodes are made uniform at the resistance value that corresponds to the lead electrode of which the length of the lead of the discrete lead electrode is the longest.

8. An inkjet head, comprising:

a plurality of ink discharge nozzles which are arranged two-dimensionally;

a plurality of pressure chambers which are in communication with the ink discharge nozzles so as to store ink, the pressure chambers being two-dimensionally arranged in correspondence with the ink discharge nozzles;

a plurality of piezoelectric elements;

a common electrode which is disposed on pressure chamber sides of the piezoelectric elements;

a plurality of discrete electrodes which are disposed on sides of the piezoelectric elements opposite to the common electrode; and a plurality of discrete lead electrodes which feed electricity to the discrete electrodes, wherein:

each of the piezoelectric elements is deformed by applying voltage to the common electrode and the discrete electrode so that a volume of the pressure chamber is varied to discharge a droplet of the ink from the ink discharge nozzle;

with respect to each pair of the discrete electrode and discrete lead electrode corresponding to each of the pressure chambers, when T1 is a thickness of the discrete electrode and T2 is a thickness of the discrete lead electrode which feed electricity to the discrete electrode, the discrete electrode and the discrete lead electrode are configured so that T1 and T2 satisfy the following formula:

$$T1<T2; \text{ and}$$

when D is a width in a breadthways direction of the discrete electrode, T1 is the thickness of the discrete electrode, d is a width of the discrete lead electrodes, and T2 is the thickness of the discrete lead electrode, the discrete electrode and the discrete lead electrode are configured so that the D, the T1 ,the d, and the T2 satisfy the following formulas:

$$\frac{T1}{D} \geq \frac{1}{1000} \text{ and } \frac{T2}{d} \geq 2.$$

9. An inkjet head, comprising:

a plurality of ink discharge nozzles which are arranged two-dimensionally;

a plurality of pressure chambers which are in communication with the ink discharge nozzles so as to store ink, the pressure chambers being two-dimensionally arranged in correspondence with the ink discharge nozzles;

a plurality of piezoelectric elements;

a common electrode which is disposed on pressure chamber sides of the piezoelectric elements;

a plurality of discrete electrodes which are disposed on sides of the piezoelectric elements opposite to the common electrode; and a plurality of discrete lead electrodes which feed electricity to the discrete electrodes, wherein:

each of the piezoelectric elements is deformed by applying voltage to the common electrode and the discrete electrode so that a volume of the pressure chamber is varied to discharge a droplet of the ink from the ink discharge nozzle;

with respect to each pair of the discrete electrode and discrete lead electrode corresponding to each of the pressure chambers, when T1 is a thickness of the discrete electrode and T2 is a thickness of the discrete lead electrode which feed electricity to the discrete electrode, the discrete electrode and the discrete lead electrode are configured so that T1 and T2 satisfy the following formula:

$$T1<T2; \text{ and}$$

the thicknesses T2 of the discrete lead electrodes are adjusted so that permissible resistance values of the discrete lead electrodes are equal to each other by increasing the thickness of a particular discrete lead electrode based on a wiring length of that discrete lead electrode, such that a longer wiring length is associated with a thicker discrete lead electrode.

* * * * *